US009739225B2

(12) United States Patent
Nakagawa et al.

(10) Patent No.: US 9,739,225 B2
(45) Date of Patent: Aug. 22, 2017

(54) CONTROL SYSTEM OF INTERNAL COMBUSTION ENGINE

(71) Applicant: TOYOTA JIDOSHA KABUSHIKI KAISHA, Toyota-shi, Aichi (JP)

(72) Inventors: Norihisa Nakagawa, Susono (JP); Shuntaro Okazaki, Shizuoka (JP); Yuji Yamaguchi, Susono (JP)

(73) Assignee: TOYOTA JIDOSHA KABUSHIKI KAISHA, Toyota-shi, Aichi (JP)

( * ) Notice: Subject to any disclaimer, the term of this patent is extended or adjusted under 35 U.S.C. 154(b) by 0 days.

(21) Appl. No.: 15/033,359

(22) PCT Filed: Oct. 17, 2014

(86) PCT No.: PCT/JP2014/077711
§ 371 (c)(1),
(2) Date: Apr. 29, 2016

(87) PCT Pub. No.: WO2015/064390
PCT Pub. Date: May 7, 2015

(65) Prior Publication Data

US 2016/0273466 A1 Sep. 22, 2016

(30) Foreign Application Priority Data

Nov. 1, 2013 (JP) ..... 2013-228346

(51) Int. Cl.
*F01N 3/00* (2006.01)
*F02D 41/02* (2006.01)
(Continued)

(52) U.S. Cl.
CPC ..... *F02D 41/0295* (2013.01); *F01N 3/0814* (2013.01); *F01N 3/0842* (2013.01);
(Continued)

(58) Field of Classification Search
CPC ..... F02D 41/0235; F02D 41/0295; F02D 41/1441; F01N 3/0864; F01N 3/20; F01N 3/0842
(Continued)

(56) References Cited

U.S. PATENT DOCUMENTS 5,293,740 A * 3/1994 Heppner ..... F01N 9/00 60/274
5,758,490 A 6/1998 Maki et al.
(Continued)

FOREIGN PATENT DOCUMENTS

DE 41 28 718 A1 3/1993
JP H08-232723 9/1996
(Continued)

*Primary Examiner* — Jason Shanske
(74) *Attorney, Agent, or Firm* — Andrews Kurth Kenyon LLP

(57) ABSTRACT

The control system of an internal combustion engine performs normal operation control including lean control for making the air-fuel ratio of the exhaust gas flowing into the exhaust purification catalyst a lean air-fuel ratio, and rich control for making the air-fuel ratio of the exhaust gas flowing into the exhaust purification catalyst a rich air-fuel ratio. The normal operation control includes judgment reference decreasing control decreasing the judgment reference storage amount in the lean control when during the time period of performing the lean control, the air-fuel ratio of the exhaust gas flowing out from the exhaust purification catalyst becomes the lean judged air-fuel ratio or more. The control system judges that the exhaust purification catalyst is abnormal when the judgment reference storage amount becomes less than a deterioration judgment value.

6 Claims, 16 Drawing Sheets

(51) Int. Cl.
*F02D 41/14* (2006.01)
*F01N 3/08* (2006.01)
*F01N 3/20* (2006.01)

(52) U.S. Cl.
CPC ..... *F01N 3/0864* (2013.01); *F01N 3/20* (2013.01); *F02D 41/0235* (2013.01); *F02D 41/1441* (2013.01); *F02D 41/1495* (2013.01); *F01N 2390/02* (2013.01); *F01N 2430/06* (2013.01); *F01N 2560/02* (2013.01); *F01N 2570/16* (2013.01); *F02D 2200/0814* (2013.01); *F02D 2200/0816* (2013.01)

(58) Field of Classification Search
USPC ..... 60/285
See application file for complete search history.

(56) References Cited

U.S. PATENT DOCUMENTS

| | | | | |
|---|---|---|---|---|
| 6,116,021 | A * | 9/2000 | Schumacher | F01N 11/00 123/674 |
| 2003/0017603 | A1 * | 1/2003 | Uchida | B01D 53/9495 436/37 |
| 2016/0061084 | A1 | 3/2016 | Okazaki et al. | |

FOREIGN PATENT DOCUMENTS

| | | | |
|---|---|---|---|
| JP | 2001-234787 | A | 8/2001 |
| JP | 2009-062139 | A | 7/2009 |
| JP | 2011-069337 | A | 4/2011 |
| WO | 2014/118892 | A | 8/2014 |

* cited by examiner

CONTROL SYSTEM OF INTERNAL COMBUSTION ENGINE

CROSS-REFERENCE TO RELATED APPLICATIONS

This is a national phase application based on the PCT International Patent Application No. PCT/JP2014/077711 filed Oct. 17, 2014, claiming priority to Japanese Patent Application No. 2013-228346 filed Nov. 1, 2013, the entire contents of both of which are incorporated herein by reference.

TECHNICAL FIELD

The present invention relates to a control system of an internal combustion engine.

BACKGROUND ART

The exhaust gas discharged from a combustion chamber contains unburned gas, $NO_X$, etc. To remove such components of the exhaust gas, an exhaust purification catalyst is arranged in an engine exhaust passage. As an exhaust purification catalyst able to simultaneously remove unburned gas, $NO_X$, and other components, a three-way catalyst is known. A three-way catalyst can remove unburned gas, $NO_X$, etc. with a high removal rate when an air-fuel ratio of the exhaust gas is near a stoichiometric air-fuel ratio. For this reason, there is known a control system which provides an air-fuel ratio sensor in an exhaust passage of an internal combustion engine and uses the output value of this air-fuel ratio sensor as the basis to control an amount of fuel fed to the internal combustion engine.

As the exhaust purification catalyst, one having an oxygen storage ability can be used. An exhaust purification catalyst having an oxygen storage ability can remove unburned gas (HC, CO, etc.), $NO_X$, etc. when the oxygen storage amount is a suitable amount between an upper limit storage amount and a lower limit storage amount even_if the air-fuel ratio of the exhaust gas flowing into the exhaust purification catalyst is rich. If exhaust gas of an air-fuel ratio at the rich side from the stoichiometric air-fuel ratio (below, referred to as a "rich air-fuel ratio") flows into the exhaust purification catalyst, the oxygen stored in the exhaust purification catalyst is used to remove by oxidation the unburned gas in the exhaust gas.

Conversely, if exhaust gas of an air-fuel ratio at a lean side from the stoichiometric air-fuel ratio (below, referred to as a "lean air-fuel ratio") flows into the exhaust purification catalyst, the oxygen in the exhaust gas is stored in the exhaust purification catalyst. Due to this, the surface of the exhaust purification catalyst becomes an oxygen deficient state. Along with this, the $NO_X$ in the exhaust gas is removed by reduction. In this way, the exhaust purification catalyst can purify the exhaust gas so long as the oxygen storage amount is a suitable amount regardless of the air-fuel ratio of the exhaust gas flowing into the exhaust purification catalyst.

Therefore, in such a control system, to maintain the oxygen storage amount at the exhaust purification catalyst at a suitable amount, an air-fuel ratio sensor is provided at the upstream side of the exhaust purification catalyst in the direction of flow of exhaust, and an oxygen sensor is provided at the downstream side in the direction of flow of exhaust. Using these sensors, the control system uses the output of the upstream side air-fuel ratio sensor as the basis for feedback control so that the output of this air-fuel ratio sensor becomes a target value corresponding to the target air-fuel ratio. In addition, the output of the downstream side oxygen sensor is used as the basis to correct the target value of the upstream side air-fuel ratio sensor.

For example, in the control system described in Japanese Patent Publication No. 2011-069337A, when the output voltage of the downstream side oxygen sensor is a high side threshold value or more and the exhaust purification catalyst is in an oxygen deficient state, the target air-fuel ratio of the exhaust gas flowing into the exhaust purification catalyst is made a lean air-fuel ratio. Conversely, when the output voltage of the downstream side oxygen sensor is a low side threshold value or less and the exhaust purification catalyst is in an oxygen excess state, the target air-fuel ratio is made a rich air-fuel ratio. Due to this control, when in the oxygen deficient state or oxygen excess state, it is considered possible to quickly return the state of the exhaust purification catalyst to a state between these two states, that is, a state where the exhaust purification catalyst stores a suitable amount of oxygen.

Further, in the control system described in Japanese Patent Publication No. 2001-234787A, the outputs of an air flowmeter and upstream side air-fuel ratio sensor of an exhaust purification catalyst etc. are used as the basis to calculate an oxygen storage amount of the exhaust purification catalyst. In addition, when the calculated oxygen storage amount is larger than a target oxygen storage amount, the target air-fuel ratio of the exhaust gas flowing into the exhaust purification catalyst is made a rich air-fuel ratio, and when the calculated oxygen storage amount is smaller than a target oxygen storage amount, the target air-fuel ratio is made the lean air-fuel ratio. Due to this control, it is considered that the oxygen storage amount of the exhaust purification catalyst can be maintained constant at the target oxygen storage amount.

CITATION LIST

Patent Literature

PLT 1. Japanese Patent Publication No. 2011-069337A
PLT 2. Japanese Patent Publication No. 2001-234787A
PLT 3. Japanese Patent Publication No. 8-232723A
PLT 4. Japanese Patent Publication No. 2009-162139A

SUMMARY OF INVENTION

Technical Problem

An exhaust purification catalyst having an oxygen storage ability becomes hard to store the oxygen in the exhaust gas when the oxygen storage amount becomes near the maximum oxygen storage amount if the air-fuel ratio of the exhaust gas flowing into the exhaust purification catalyst is a lean air-fuel ratio. The inside of the exhaust purification catalyst becomes a state of oxygen excess. The $NO_X$ contained in the exhaust gas becomes hard to be removed by reduction. For this reason, if the oxygen storage amount becomes near the maximum oxygen storage amount, the concentration of $NO_X$ of the exhaust gas flowing out from the exhaust purification catalyst rapidly rises.

For this reason, as disclosed in Japanese Patent Publication No. 2011-069337A, if control is performed to set the target air-fuel ratio to the rich air-fuel ratio when the output voltage of the downstream side oxygen sensor has become the low side threshold value or less, there is the problem that a certain extent of $NO_X$ flows out from the exhaust purification catalyst.

FIG. 17 is a time chart explaining the relationship between an air-fuel ratio of exhaust gas flowing into an exhaust purification catalyst and a concentration of $NO_X$ flowing out from the exhaust purification catalyst. FIG. 17 is a time chart of the oxygen storage amount of the exhaust purification catalyst, the air-fuel ratio of the exhaust gas detected by the downstream side oxygen sensor, the target air-fuel ratio of the exhaust gas flowing into the exhaust purification catalyst, the air-fuel ratio of the exhaust gas detected by the upstream side air-fuel ratio sensor, and the concentration of $NO_X$ in the exhaust gas flowing out from the exhaust purification catalyst.

In the state before the time $t_1$, the target air-fuel ratio of the exhaust gas flowing into the exhaust purification catalyst is made a lean air-fuel ratio. For this reason, the oxygen storage amount of the exhaust purification catalyst is gradually increased. On the other hand, all of the oxygen in the exhaust gas flowing into the exhaust purification catalyst is stored in the exhaust purification catalyst, so the exhaust gas flowing out from the exhaust purification catalyst does not contain much oxygen at all. For this reason, the air-fuel ratio of the exhaust gas detected by the downstream side oxygen sensor becomes substantially the stoichiometric air-fuel ratio. In the same way, the $NO_X$ in the exhaust gas flowing into the exhaust purification catalyst is completely removed by reduction in the exhaust purification catalyst, so the exhaust gas flowing out from the exhaust purification catalyst does not contain much $NO_X$ at all.

When the oxygen storage amount of the exhaust purification catalyst gradually increases and approaches the maximum oxygen storage amount Cmax, part of the oxygen in the exhaust gas flowing into the exhaust purification catalyst is no longer be stored in the exhaust purification catalyst. As a result, from the time $t_1$, the exhaust gas flowing out from the exhaust purification catalyst starts to contain oxygen. For this reason, the air-fuel ratio of the exhaust gas detected by the downstream side oxygen sensor becomes the lean air-fuel ratio. After that, when the oxygen storage amount of the exhaust purification catalyst further increases, the air-fuel ratio of the exhaust gas flowing out from the exhaust purification catalyst reaches a predetermined upper limit air-fuel ratio AFhighref (corresponding to low side threshold value) and the target air-fuel ratio is switched to a rich air-fuel ratio.

If the target air-fuel ratio is switched to a rich air-fuel ratio, the fuel injection amount in the internal combustion engine is made to increase to match the switched target air-fuel ratio. Even if the fuel injection amount is increased in this way, there is a certain extent of distance from the internal combustion engine body to the exhaust purification catalyst, so the air-fuel ratio of the exhaust gas flowing into the exhaust purification catalyst does not immediately change to the rich air-fuel ratio. A delay occurs. For this reason, even if the target air-fuel ratio is switched at the time $t_2$ to the rich air-fuel ratio, up to the time $t_3$, the air-fuel ratio of the exhaust gas flowing into the exhaust purification catalyst remains at the lean air-fuel ratio. For this reason, in the interval from the time $t_2$ to the time $t_3$, the oxygen storage amount of the exhaust purification catalyst reaches the maximum oxygen storage amount Cmax or becomes a value near the maximum oxygen storage amount Cmax and, as a result, oxygen and $NO_X$ flow out from the exhaust purification catalyst. After that, at the time $t_3$, the air-fuel ratio of the exhaust gas flowing into the exhaust purification catalyst becomes the rich air-fuel ratio, and the air-fuel ratio of the exhaust gas flowing out from the exhaust purification catalyst converges to the stoichiometric air-fuel ratio.

In this way, a delay occurs from when switching the target air-fuel ratio from the lean air-fuel ratio to the rich air-fuel ratio to when the air-fuel ratio of the exhaust gas flowing into the exhaust purification catalyst becomes the rich air-fuel ratio. As a result, in the time period from the time $t_1$ to the time $t_4$, $NO_X$ ended up flowing out from the exhaust purification catalyst.

An object of the present invention is to provide a control system of an internal combustion engine provided with an exhaust purification catalyst having an oxygen storage ability, which suppresses the outflow of $NO_X$.

Solution to Problem

A first control system of an internal combustion engine of the present invention is a control system of an internal combustion engine provided with an exhaust purification catalyst having an oxygen storage ability in an engine exhaust passage, the control system comprising: an upstream side air-fuel ratio sensor arranged upstream of the exhaust purification catalyst and detecting an air-fuel ratio of exhaust gas flowing into the exhaust purification catalyst, a downstream side air-fuel ratio sensor arranged downstream of the exhaust purification catalyst and detecting an air-fuel ratio of exhaust gas flowing out from the exhaust purification catalyst, and an oxygen storage amount acquiring means for acquiring a storage amount of oxygen stored in the exhaust purification catalyst, wherein the control system is configured to perform normal operation control including lean control for continuously or discontinuously making the air-fuel ratio of the exhaust gas flowing into the exhaust purification catalyst a lean set air-fuel ratio leaner than the stoichiometric air-fuel ratio until an oxygen storage amount of the exhaust purification catalyst becomes a judgment reference storage amount, which is a maximum oxygen storage amount or less, or becomes more, and rich control for continuously or discontinuously making the air-fuel ratio of the exhaust gas flowing into the exhaust purification catalyst a rich set air-fuel ratio richer than the stoichiometric air-fuel ratio until an output of the downstream side air-fuel ratio sensor becomes a rich judged air-fuel ratio, which is an air-fuel ratio richer than the stoichiometric air-fuel ratio, or becomes less, the normal operation control includes control switching to the rich control during the time period of the lean control when the oxygen storage amount becomes the judgment reference storage amount or more and switching to the lean control during the time period of the rich control when the output of the downstream side air-fuel ratio sensor becomes the rich judged air-fuel ratio or less, a lean judged air-fuel ratio is preset in a region where the air-fuel ratio of the exhaust gas flowing out from the exhaust purification catalyst is a lean air-fuel ratio leaner than the stoichiometric air-fuel ratio, the normal operation control includes judgment reference decreasing control decreasing the judgment reference storage amount in the lean control when during the time period of performing the lean control, the air-fuel ratio of the exhaust gas flowing out from the exhaust purification catalyst becomes the lean judged air-fuel ratio or more, and the control system judges that the exhaust purification catalyst is abnormal when the judgment reference storage amount becomes less than a predetermined deterioration judgment value.

In the above invention, the control system can detect the number of times of performing the lean control and the number of times the air-fuel ratio of the exhaust gas flowing out from the exhaust purification catalyst has become the lean judged air-fuel ratio or more, and perform the judgment reference decreasing control when a ratio of the number of times the air-fuel ratio of the exhaust gas flowing out from the exhaust purification catalyst has become the lean judged air-fuel ratio or more to the number of times of performing the lean control becomes larger than a predetermined judgment value.

In the above invention, the normal operation control can include control maintaining the judgment reference storage amount when the air-fuel ratio of the exhaust gas flowing out from the exhaust purification catalyst is being maintained at less than the lean judged air-fuel ratio during the time period of performing the lean control.

A second control system of an internal combustion engine of the present invention is a control system of an internal combustion engine provided with an exhaust purification catalyst having an oxygen storage ability in an engine exhaust passage, the control system comprising: an upstream side air-fuel ratio sensor arranged upstream of the exhaust purification catalyst and detecting an air-fuel ratio of exhaust gas flowing into the exhaust purification catalyst, a downstream side air-fuel ratio sensor arranged downstream of the exhaust purification catalyst and detecting an air-fuel ratio of exhaust gas flowing out from the exhaust purification catalyst, and an oxygen storage amount acquiring means for acquiring a storage amount of oxygen stored in the exhaust purification catalyst, wherein the control system is configured to perform normal operation control including lean control for continuously or discontinuously making the air-fuel ratio of the exhaust gas flowing into the exhaust purification catalyst a lean set air-fuel ratio leaner than the stoichiometric air-fuel ratio until an oxygen storage amount of the exhaust purification catalyst becomes a judgment reference storage amount, which is a maximum oxygen storage amount or less, or becomes more, and rich control for continuously or discontinuously making the air-fuel ratio of the exhaust gas flowing into the exhaust purification catalyst a rich set air-fuel ratio richer than the stoichiometric air-fuel ratio until an output of the downstream side air-fuel ratio sensor becomes a rich judged air-fuel ratio, which is an air-fuel ratio richer than the stoichiometric air-fuel ratio, or becomes less, the normal operation control includes control switching to the rich control during the time period of lean control when the oxygen storage amount becomes the judgment reference storage amount or more and switching to the lean control during the time period of rich control when the output of the downstream side air-fuel ratio sensor becomes the rich judged air-fuel ratio or less, a lean judged air-fuel ratio is preset in a region where the air-fuel ratio of the exhaust gas flowing out from the exhaust purification catalyst is a lean air-fuel ratio leaner than the stoichiometric air-fuel ratio, the control system detects the number of times of performing the lean control and the number of times the air-fuel ratio of the exhaust gas flowing out from the exhaust purification catalyst has become the lean judged air-fuel ratio or more, and the control system judges that the exhaust purification catalyst is abnormal when a ratio of the number of times the air-fuel ratio of the exhaust gas flowing out from the exhaust purification catalyst has become the lean judged air-fuel ratio or more to the number of times of performing the lean control becomes larger than a predetermined ratio judgment value.

Advantageous Effects of Invention

According to the present invention, there is provided a control system of an internal combustion engine, which suppresses the outflow of $NO_X$.

DESCRIPTION OF EMBODIMENTS

Referring to FIG. 1 to FIG. 16, a control system of an internal combustion engine of an embodiment will be explained. The internal combustion engine in the present embodiment is provided with an engine body outputting a rotational force and an exhaust processing system purifying the exhaust flowing out from the combustion chamber.

Figure 1:
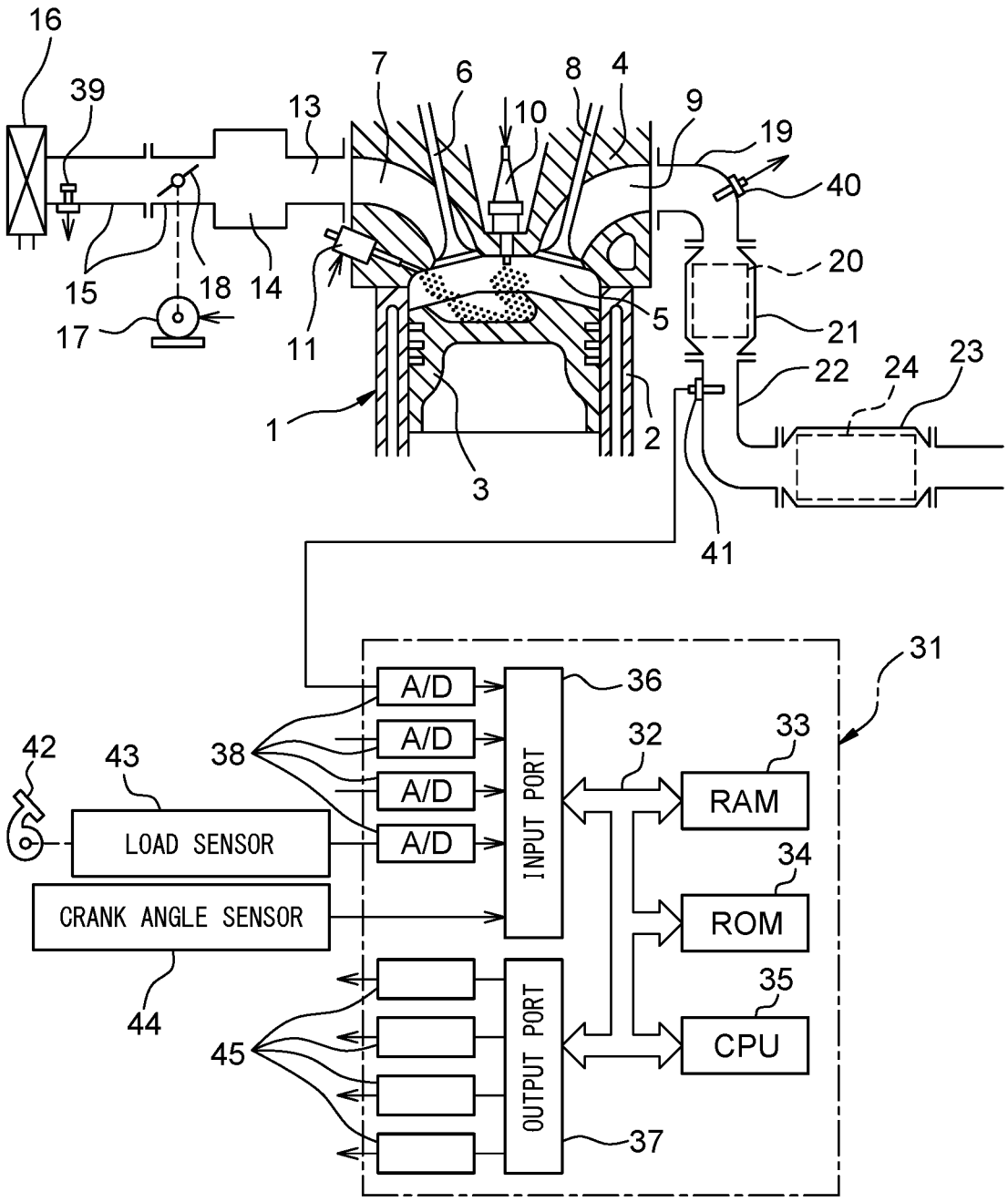
FIG. 1 A schematic view of an internal combustion engine in an embodiment.

<Explanation of Internal Combustion Engine as a Whole> FIG. 1 is a view schematically showing an internal combustion engine in the present embodiment. The internal combustion engine is provided with an engine body 1. The engine body 1 includes a cylinder block 2 and a cylinder head 4 which is fastened to the cylinder block 2. Bore parts are formed in the cylinder block 2. Pistons 3 are arranged reciprocating inside the bore parts. Combustion chambers 5 are formed by the spaces surrounded by the bore parts of the cylinder block 2, pistons 3, and cylinder head 4. The cylinder head 4 is formed with intake ports 7 and exhaust ports 9. The intake valves 6 are formed to open and close the intake ports 7, while exhaust valves 8 are formed to open and close the exhaust ports 9.

At the inside wall surface of the cylinder head 4, at a center part of each combustion chamber 5, a spark plug 10 is arranged. At a circumferential part at the inside wall surface of the cylinder head 4, a fuel injector 11 is arranged. The spark plug 10 is configured to generate a spark in accordance with an ignition signal. Further, the fuel injector 11 injects a predetermined amount of fuel into each combustion chamber 5 in accordance with an injection signal. Note that, the fuel injector 11 may also be arranged to inject fuel into an intake port 7. Further, in the present embodiment, as the fuel, gasoline with a stoichiometric air-fuel ratio of 14.6 is used. However, the internal combustion engine of the present invention may also use other fuel.

The intake port 7 of each cylinder is connected through a corresponding intake runner 13 to a surge tank 14, while the surge tank 14 is connected through an intake pipe 15 to an air cleaner 16. The intake ports 7, intake runners 13, surge tank 14, and intake pipe 15 form an "engine intake passage". Further, inside the intake pipe 15, a throttle valve 18 driven by a throttle valve driving actuator 17 is arranged. The throttle valve 18 can be operated by the throttle valve drive actuator 17 whereby it is possible to change the opening area of the intake passage.

On the other hand, the exhaust port 9 of each cylinder is connected to an exhaust manifold 19. The exhaust manifold 19 has a plurality of runners which are connected to the exhaust ports 9 and a header at which these runners merge. The header of the exhaust manifold 19 is connected to an upstream side casing 21 in which an upstream side exhaust purification catalyst 20 is provided. The upstream side casing 21 is connected through an exhaust pipe 22 to a downstream side casing 23 in which a downstream side exhaust purification catalyst 24 is provided. The exhaust ports 9, exhaust manifold 19, upstream side casing 21, exhaust pipe 22, and downstream side casing 23 form an "engine exhaust passage".

The control system of an internal combustion engine of the present embodiment includes an electronic control unit (ECU) 31. The electronic control unit 31 in the present embodiment is comprised of a digital computer which is provided with parts connected with each other through a bidirectional bus 32 such as a RAM (random access memory) 33, ROM (read only memory) 34, CPU (microprocessor) 35, input port 36, and output port 37.

Inside the intake pipe 15, an air flowmeter 39 is arranged for detecting the flow rate of air flowing through the inside of the intake pipe 15. The output of this air flowmeter 39 is input through a corresponding AD converter 38 to the input port 36.

Further, at the header of the exhaust manifold 19, an upstream side air-fuel ratio sensor 40 is arranged for detecting the air-fuel ratio of the exhaust gas flowing through the inside of the exhaust manifold 19 (that is, the exhaust gas flowing into the upstream side exhaust purification catalyst 20). In addition, inside the exhaust pipe 22, a downstream side air-fuel ratio sensor 41 is arranged for detecting the air-fuel ratio of the exhaust gas flowing through the inside of the exhaust pipe 22 (that is, the exhaust gas flowing out from the upstream side exhaust purification catalyst 20 and flowing into the downstream side exhaust purification catalyst 24). The outputs of these air-fuel ratio sensors are also input through the corresponding AD converters 38 to the input port 36. Note that, the configurations of these air-fuel ratio sensors will be explained later.

Further, an accelerator pedal 42 is connected to a load sensor 43 for generating an output voltage proportional to the amount of depression of the accelerator pedal 42, while the output voltage of the load sensor 43 is input through a corresponding AD converter 38 to the input port 36. The crank angle sensor 44, for example, generates an output pulse each time a crankshaft rotates by 15 degrees. This output pulse is input to the input port 36. The CPU 35 calculates the engine speed from the output pulses of the crank angle sensor 44. On the other hand, the output port 37 is connected through the corresponding drive circuit 45 to the spark plugs 10, fuel injectors 11, and the throttle valve drive actuator 17.

<Explanation of Exhaust Purification Catalyst>

The exhaust processing system of an internal combustion engine of the present embodiment is provided with a plurality of exhaust purification catalysts. The exhaust processing system of the present embodiment includes an upstream side exhaust purification catalyst 20 and a downstream side exhaust purification catalyst 24 arranged downstream from the exhaust purification catalyst 20. The upstream side exhaust purification catalyst 20 and downstream side exhaust purification catalyst 24 have similar configurations. Below, only the upstream side exhaust purification catalyst 20 will be explained, but the downstream side exhaust purification catalyst 24 also has a similar configuration and action.

The upstream side exhaust purification catalyst 20 is a three-way catalyst having an oxygen storage ability. Specifically, the upstream side exhaust purification catalyst 20 is comprised of a carrier made of a ceramic on which a precious metal having a catalytic action (for example, platinum (Pt), palladium (Pd), and rhodium (Rh)) and a substance having an oxygen storage ability (for example, ceria ($CeO_2$)) are carried. The upstream side exhaust purification catalyst 20 exhibits a catalytic action simultaneously removing unburned gas (HC, CO, etc.) and nitrogen oxides ($NO_X$) when reaching a predetermined activation temperature and also an oxygen storage ability.

According to the oxygen storage ability of the upstream side exhaust purification catalyst 20, the upstream side exhaust purification catalyst 20 stores the oxygen in the exhaust gas when the air-fuel ratio of the exhaust gas flowing into the upstream side exhaust purification catalyst 20 is leaner than the stoichiometric air-fuel ratio (lean air-fuel ratio). On the other hand, the upstream side exhaust purification catalyst 20 releases the oxygen stored in the upstream side exhaust purification catalyst 20 when the air-fuel ratio of the inflowing exhaust gas is richer than the stoichiometric air-fuel ratio (rich air-fuel ratio). Note that, the "air-fuel ratio of the exhaust gas" means the ratio of the mass of fuel to the mass of air fed until that exhaust gas is produced. Usually, it means the ratio of the mass of fuel to the mass of air fed to the inside of a combustion chamber 5 when the exhaust gas is generated. In the Description, the air-fuel ratio of the exhaust gas will sometimes be referred to as the "exhaust air-fuel ratio". Next, the relationship between the oxygen storage amount of the exhaust purification catalyst and purification ability in the present embodiment will be explained.

Figure 2A:
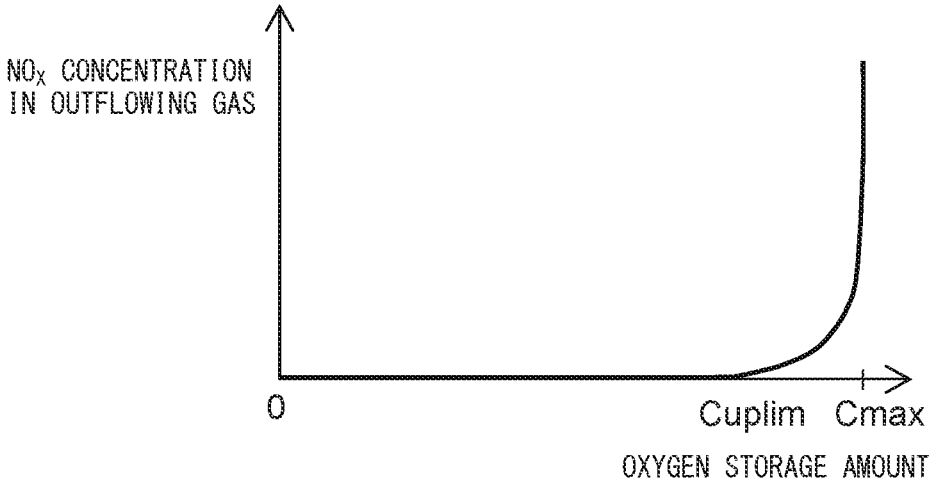
FIG. 2A A view showing a relationship of an oxygen storage amount of an exhaust purification catalyst and $NO_X$ in exhaust gas flowing out from the exhaust purification catalyst.
Figure 2B:
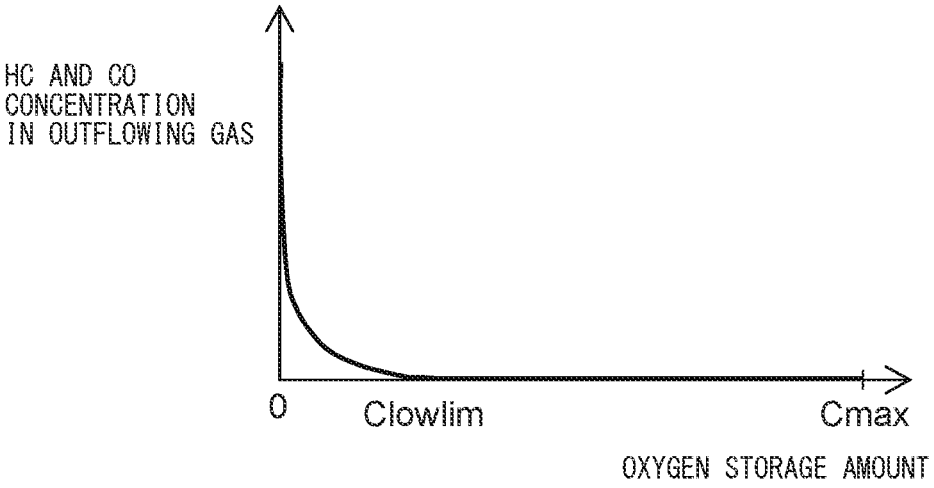
FIG. 2B A view showing a relationship of an oxygen storage amount of an exhaust purification catalyst and a concentration of unburned gas in exhaust gas flowing out from the exhaust purification catalyst.

FIG. 2A and FIG. 2B shows the relationship between the oxygen storage amount of the exhaust purification catalyst and the concentration of the $NO_X$ and unburned gas (HC, CO, etc.) in the exhaust gas flowing out from the exhaust purification catalyst. FIG. 2A shows the relationship between the oxygen storage amount and the concentration of $NO_X$ in the exhaust gas flowing out from the exhaust purification catalyst when the air-fuel ratio of the exhaust gas flowing into the exhaust purification catalyst is a lean air-fuel ratio. On the other hand, FIG. 2B shows the relationship between the oxygen storage amount and the concentration of unburned gas in the exhaust gas flowing out from the exhaust purification catalyst when the air-fuel ratio of the exhaust gas flowing into the exhaust purification catalyst is a rich air-fuel ratio.

As will be understood from FIG. 2A, when the oxygen storage amount of the exhaust purification catalyst is small, there is an extra margin until the maximum oxygen storage amount. For this reason, even if the air-fuel ratio of the exhaust gas flowing into the exhaust purification catalyst is a lean air-fuel ratio (that is, this exhaust gas contains $NO_X$ and oxygen), the oxygen in the exhaust gas is stored in the exhaust purification catalyst. Along with this, $NO_X$ is also removed by reduction. As a result of this, the exhaust gas flowing out from the exhaust purification catalyst does not contain much $NO_X$.

However, if the oxygen storage amount of the exhaust purification catalyst becomes larger, when the air-fuel ratio of the exhaust gas flowing into the exhaust purification catalyst is a lean air-fuel ratio, it becomes harder for the exhaust purification catalyst to store the oxygen in the exhaust gas. Along with this, the $NO_X$ in the exhaust gas also becomes harder to be removed by reduction. For this reason, as will be understood from FIG. 2A, if the oxygen storage amount increases beyond the upper limit storage amount Cuplim near the maximum oxygen storage amount Cmax, the concentration of $NO_X$ in the exhaust gas flowing out from the exhaust purification catalyst rapidly rises.

On the other hand, when the oxygen storage amount of the exhaust purification catalyst is large, if the air-fuel ratio of the exhaust gas flowing into the exhaust purification catalyst is the rich air-fuel ratio (that is, this exhaust gas includes HC, CO, or other unburned gas), the oxygen stored in the exhaust purification catalyst is released. For this reason, the unburned gas in the exhaust gas flowing into the exhaust purification catalyst is removed by oxidation. As a result of this, as will be understood from FIG. 2B, the exhaust gas flowing out from the exhaust purification catalyst does not contain much unburned gas.

However, if the oxygen storage amount of the exhaust purification catalyst becomes smaller and becomes near 0, if the air-fuel ratio of the exhaust gas flowing into the exhaust purification catalyst is the rich air-fuel ratio, the oxygen released from the exhaust purification catalyst becomes smaller and along with this the unburned gas in the exhaust gas also becomes harder to be removed by oxidation. For this reason, as will be understood from FIG. 2B, if the oxygen storage amount decreases below a certain lower limit storage amount Clowlim, the concentration of unburned gas in the exhaust gas flowing out from the exhaust purification catalyst rapidly rises.

In the above way, according to the exhaust purification catalysts 20 and 24 used in the present embodiment, the characteristics of removal of $NO_X$ and unburned gas in the exhaust gas change according to the air-fuel ratios of the exhaust gas flowing into the exhaust purification catalysts 20 and 24 and their oxygen storage amounts. Note that, if having a catalytic action and oxygen storage ability, the exhaust purification catalysts 20 and 24 may be catalysts different from three-way catalysts.

<Configuration of Air-Fuel Ratio Sensors>

Figure 3:
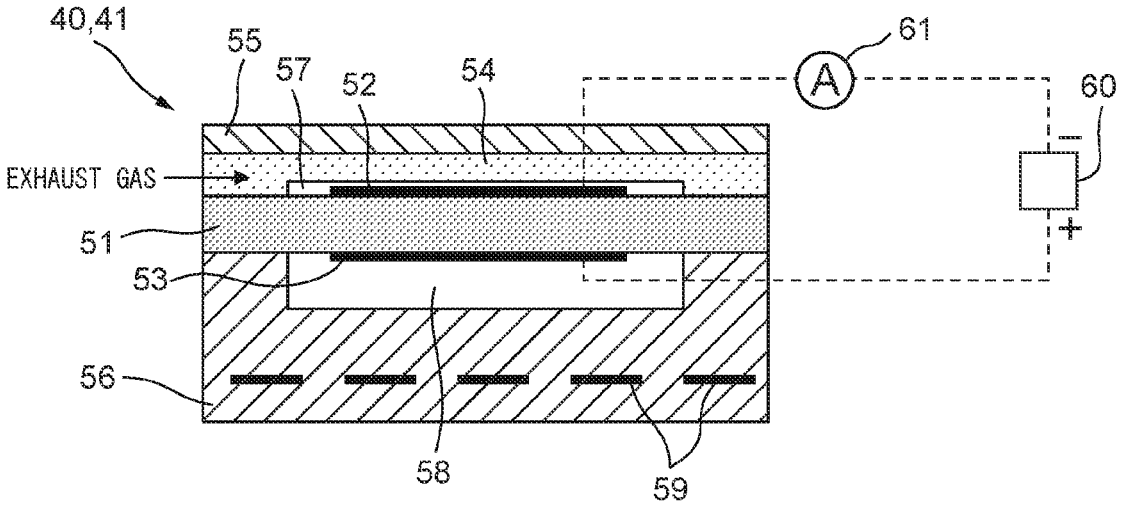
FIG. 3 A schematic cross-sectional view of an air-fuel ratio sensor.

Next, referring to FIG. 3, the structures of the upstream side air-fuel ratio sensor 40 and downstream side air-fuel ratio sensor 41 in the present embodiment will be explained. FIG. 3 is a schematic cross-sectional view of an air-fuel ratio sensor. The air-fuel ratios sensor in the present embodiment are single-cell type air-fuel ratio sensors with one cell comprised of a solid electrolyte layer and a pair of electrodes. The air-fuel ratio sensors are not limited to this. It is also possible to employ other types of sensors where the output continuously changes in accordance with the air-fuel ratio of the exhaust gas. For example, it is also possible to employ two-cell type air-fuel ratio sensors.

Each air-fuel ratio sensor in the present embodiment is provided with a solid electrolyte layer 51, an exhaust side electrode (first electrode) 52 arranged on one side surface of the solid electrolyte layer 51, an atmosphere side electrode (second electrode) 53 arranged on the other side surface of the solid electrolyte layer 51, a diffusion regulating layer 54 regulating the diffusion of the exhaust gas passing through it, a protective layer 55 protecting the diffusion regulating layer 54, and a heater part 56 for heating the air-fuel ratio sensor.

One side surface of the solid electrolyte layer 51 is provided with a diffusion regulating layer 54, while the side surface at the opposite side from the side surface of the diffusion regulating layer 54 at the solid electrolyte layer 51 side is provided with a protective layer 55. In the present embodiment, a measured gas chamber 57 is formed between the solid electrolyte layer 51 and the diffusion regulating layer 54. The gas to be detected by the air-fuel ratio sensor, that is, the exhaust gas, is introduced through the diffusion regulating layer 54 into this measured gas chamber 57. Further, the exhaust side electrode 52 is arranged inside the measured gas chamber 57, Therefore, the exhaust side electrode 52 is exposed to the exhaust gas through the diffusion regulating layer 54. Note that, the measured gas chamber 57 does not necessarily have to be provided. The system may also be configured so that the diffusion regulating layer 54 directly contacts the surface of the exhaust side electrode 52.

On the other side surface of the solid electrolyte layer 51, the heater part 56 is provided. Between the solid electrolyte layer 51 and the heater part 56, a reference gas chamber 58 is formed. Inside this reference gas chamber 58, reference gas is introduced. In the present embodiment, the reference gas chamber 58 is opened to the atmosphere. Accordingly, inside the reference gas chamber 58, atmospheric air is introduced as the reference gas. The atmosphere side electrode 53 is arranged inside the reference gas chamber 58. Therefore, the atmosphere side electrode 53 is exposed to the reference gas (reference atmosphere). In the present embodiment, since atmospheric air is used as the reference gas, the atmosphere side electrode 53 is exposed to the atmosphere.

The heater part 56 is provided with a plurality of heaters 59. These heaters 59 can be used to control the temperature of the air-fuel ratio sensor, in particular the temperature of the solid electrolyte layer 51. The heater part 56 has a sufficient heat generation capacity for heating the solid electrolyte layer 51 until activation.

The solid electrolyte layer 51 is formed by a sintered body of $ZrO_2$ (zirconium), $HfO_2$, $ThO_2$, $Bi_2O_3$, or other oxygen ion conducting oxide in which CaO, MgO, $Y_2O_3$, $Yb_2O_3$, etc. is included as a stabilizer. Further, the diffusion regulating layer 54 is formed by a porous sintered body of alumina, magnesia, silica, spinel, mullite, or other heat resistant inorganic substance. Furthermore, the exhaust side electrode 52 and atmosphere side electrode 53 are formed by platinum or another high catalytic activity precious metal.

Further, between the exhaust side electrode 52 and atmosphere side electrode 53, sensor applied voltage Vr is applied by the voltage applying device 60 mounted in the electronic control unit 31. In addition, the electronic control unit 31 is provided with a current detection device 61 which detects the current flowing through the solid electrolyte layer 51 between the exhaust side electrode 52 and the atmosphere side electrode 53 when the voltage applying device 60 applies the sensor applied voltage Vr. The current detected by this current detection device 61 is the output current of the air-fuel ratio sensor.

<Operation of Air-Fuel Ratio Sensors>

Figure 4A:
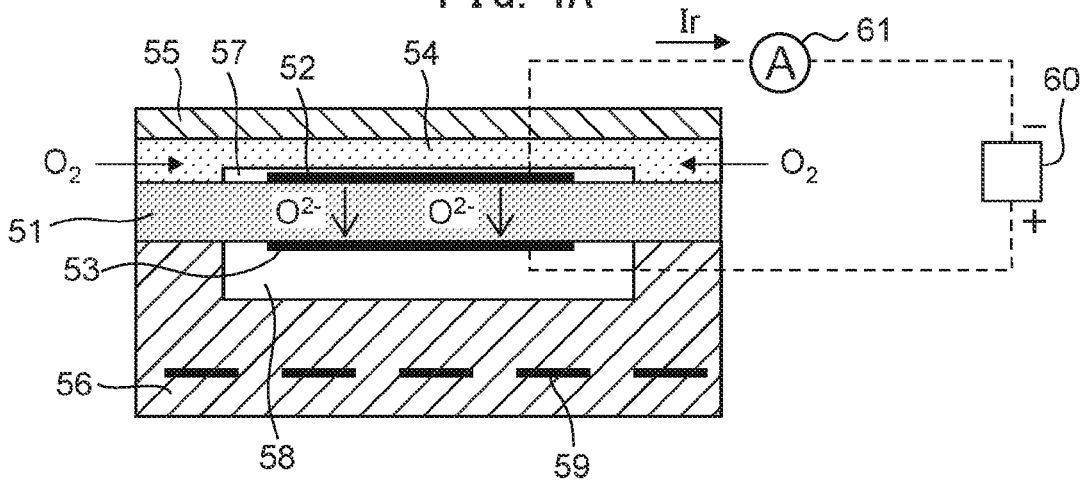
FIG. 4A A first view schematically showing an operation of an air-fuel ratio sensor.
Figure 4B:
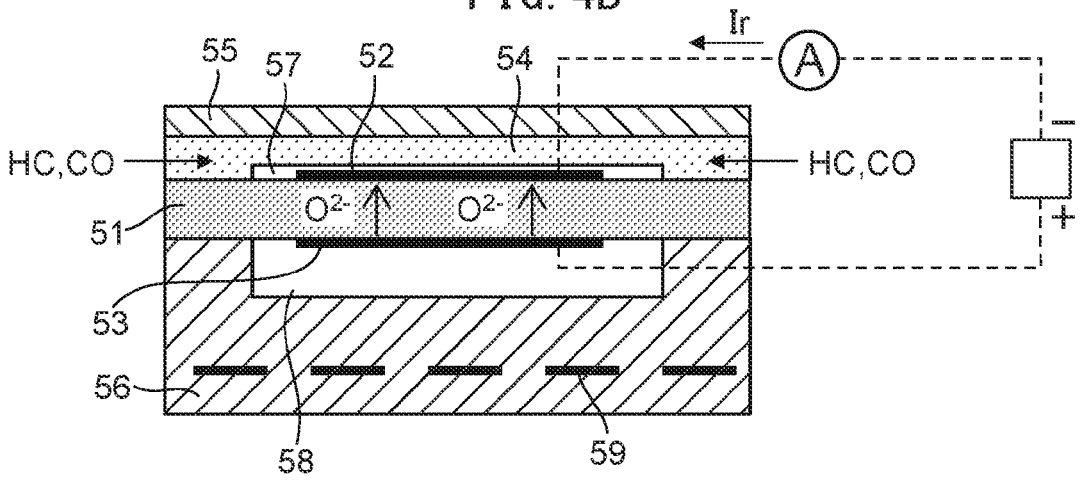
FIG. 4B A second view schematically showing an operation of an air-fuel ratio sensor.
Figure 4C:
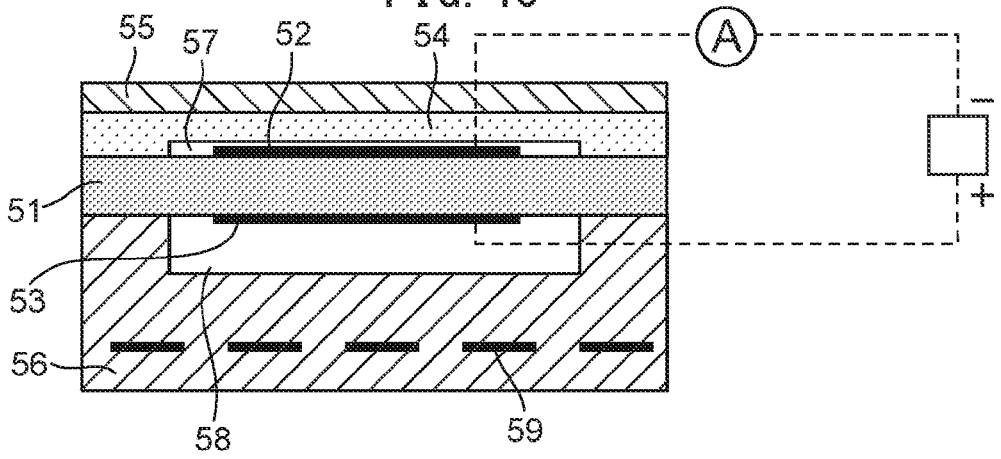
FIG. 4C A third view schematically showing an operation of an air-fuel ratio sensor.

Next, referring to FIG. 4A to FIG. 4C, the basic concept of the operation of the thus configured air-fuel ratio sensors will be explained. FIG. 4A to FIG. 4C are views schematically showing the operation of an air-fuel ratio sensor. At the time of use, the air-fuel ratio sensor is arranged so that the outer circumferential surfaces of the protective layer 55 and diffusion regulating layer 54 are exposed to the exhaust gas. Further, atmospheric air is introduced into the reference gas chamber 58 of the air-fuel ratio sensor.

As explained above, the solid electrolyte layer 51 is formed by a sintered body of an oxygen ion conducting oxide. Therefore, it has the characteristic (oxygen cell characteristic) of an electromotive force E being generated prompting movement of oxygen ions from the high concentration side surface side to the low concentration side surface side if a difference in concentration of oxygen occurs between the two side surfaces of the solid electrolyte layer 51 in the state activated by a high temperature.

Conversely, the solid electrolyte layer 51 has the characteristic (oxygen pump characteristic) of prompting the movement of oxygen ions so that an oxygen concentration ratio occurs between the two side surfaces of the solid electrolyte layer according to the potential difference if a potential difference is given between the two side surfaces. Specifically, when a potential difference is given between the two side surfaces, movement of the oxygen ions is caused so that the concentration of oxygen at the side surface given the positive polarity becomes higher than the concentration of oxygen at the side surface given the negative polarity by a ratio corresponding to the potential difference. Further, as shown in FIG. 3 and FIG. 4A to FIG. 4C, at the air-fuel ratio sensor, a constant sensor applied voltage Vr is applied between the exhaust side electrode 52 and the atmosphere side electrode 53 so that the atmosphere side electrode 53 becomes the positive polarity and the exhaust side electrode 52 becomes the negative polarity. Note that, in the present embodiment, the sensor applied voltage Vr at the air-fuel ratio sensor becomes the same voltage.

When the exhaust air-fuel ratio around the air-fuel ratio sensor is leaner than the stoichiometric air-fuel ratio, the ratio of the oxygen concentration between the two side surfaces of the solid electrolyte layer 51 is not that large. For this reason, if setting the sensor applied voltage Vr to a suitable value, the actual oxygen concentration ratio between the two side surfaces of the solid electrolyte layer 51 becomes smaller than the oxygen concentration ratio corresponding to the sensor applied voltage Vr. For this reason, as shown in FIG. 4A, movement of oxygen ions occurs from the exhaust side electrode 52 toward the atmosphere side electrode 53 so that the oxygen concentration ratio between the two side surfaces of the solid electrolyte layer 51 becomes larger toward an oxygen concentration ratio corresponding to the sensor applied voltage Vr. As a result, current flows from the positive electrode of the voltage applying device 60 applying sensor applied voltage Vr to the negative electrode through the atmosphere side electrode 53, solid electrolyte layer 51, and exhaust side electrode 52.

The magnitude of the current (output current) Ir flowing at this time is proportional to the amount of oxygen flowing from the exhaust through the diffusion regulating layer 54 to the measured gas chamber 57 if setting the sensor applied voltage Vr to a suitable value. Therefore, by detecting the magnitude of this current Ir by the current detection device 61, it is possible to determine the concentration of oxygen and in turn possible to determine the air-fuel ratio in the lean region.

On the other hand, when the exhaust air-fuel ratio around the air-fuel ratio sensor is richer than the stoichiometric air-fuel ratio, unburned gas flows from inside the exhaust through the diffusion regulating layer 54 to the inside of the measured gas chamber 57, so even if there is oxygen on the exhaust side electrode 52, it reacts with the unburned gas to be removed. For this reason, inside the measured gas chamber 57, the concentration of oxygen becomes extremely low. As a result, the ratio of the concentration of oxygen between the two side surfaces of the solid electrolyte layer 51 becomes large. For this reason, if setting the sensor applied voltage Vr at a suitable value, between the two side surfaces of the solid electrolyte layer 51, the actual oxygen concentration ratio becomes larger than the oxygen concentration ratio corresponding to the sensor applied voltage Vr. For this reason, as shown in FIG. 4*b*, movement of oxygen ions occurs from the atmosphere side electrode 53 toward the exhaust side electrode 52 so that the ratio of oxygen concentration between the two side surfaces of the solid electrolyte layer 51 becomes smaller toward an oxygen concentration ratio corresponding to the sensor applied voltage Vr. As a result, current flows from the atmosphere side electrode 53 through the voltage applying device 60 applying sensor applied voltage Vr to the exhaust side electrode 52.

The current flowing at this time becomes the output current Ir. The magnitude of the output current is determined by the flow rate of the oxygen ions which are made to move inside the solid electrolyte layer 51 from the atmosphere side electrode 53 to the exhaust side electrode 52 if setting the sensor applied voltage Vr to a suitable value. On the exhaust side electrode 52, the oxygen ions react (burn) with the unburned gas flowing from the exhaust through the diffusion regulating layer 54 into the measured gas chamber 57 by diffusion. Accordingly, the flow rate of movement of the oxygen ions corresponds to the concentration of unburned gas in the exhaust gas flowing into the measured gas chamber 57. Therefore, by detecting the magnitude of this current Ir by the current detection device 61, it is possible to determine the concentration of unburned gas and in turn possible to determine the air-fuel ratio in the rich region.

Further, when the exhaust air-fuel ratio around the air-fuel ratio sensor is the stoichiometric air-fuel ratio, the amounts of oxygen and unburned gas flowing into the measured gas chamber 57 become the chemical equivalent ratio. For this reason, due to the catalytic action of the exhaust side electrode 52, the two completely burn and no fluctuation occurs in the concentrations of oxygen and unburned gas in the measured gas chamber 57. As a result of this, the oxygen concentration ratio between the two side surfaces of the solid electrolyte layer 51 does not fluctuate but is maintained at the oxygen concentration ratio corresponding to the sensor applied voltage Vr as is. For this reason, as shown in FIG. 4C, movement of the oxygen ions due to the oxygen pump property does not occur and as a result current flowing through the circuit is not produced.

Figure 5:
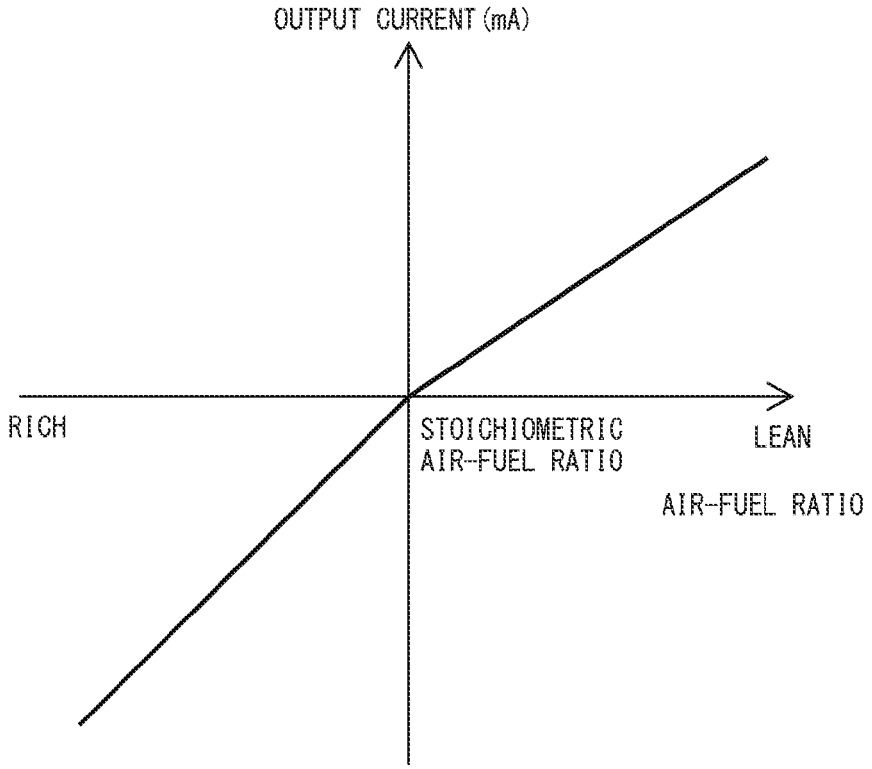
FIG. 5 A view showing a relationship of an exhaust air-fuel ratio in an air-fuel ratio sensor and an output current.

The thus configured air-fuel ratio sensor has the output characteristic shown in FIG. 5. That is, in the air-fuel ratio sensor, the larger the exhaust air-fuel ratio (that is, the leaner it becomes), the larger the output current of the air-fuel ratio sensor Ir. In addition, the air-fuel ratio sensor is configured so that the output current Ir becomes zero when the exhaust air-fuel ratio is the stoichiometric air-fuel ratio.

<Circuits of Voltage Applying Device and Current Detection Device>

Figure 6:
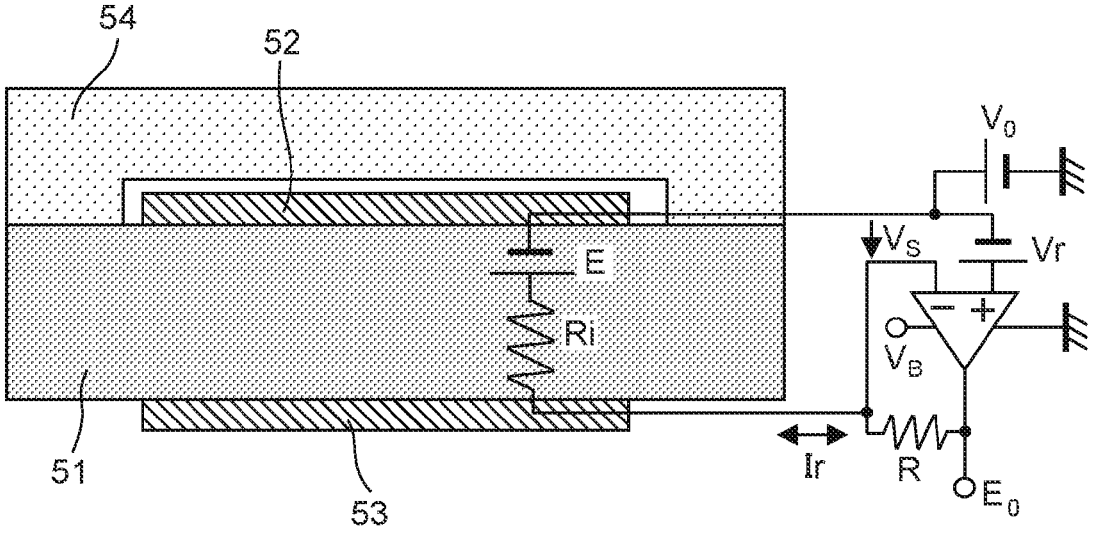
FIG. 6 A view showing one example of specific circuits forming a voltage application device and a current detection device.

FIG. 6 shows one example of the specific circuits forming the voltage applying device 60 and current detection device 61. In the illustrated example, the electromotive force generated due to the oxygen cell characteristic is indicated as "E", the internal resistance of the solid electrolyte layer 51 is indicated as "Ri", and the potential difference between the exhaust side electrode 52 and the atmosphere side electrode 53 is indicated as "Vs".

As will be understood from FIG. 6, the voltage applying device 60 basically performs negative feedback control so that the electromotive force E which is generated due to the oxygen cell characteristic matches the sensor applied voltage Vr. In other words, the voltage applying device 60 performs negative feedback control so that the potential difference Vs becomes the sensor applied voltage Vr even if the potential difference Vs between the exhaust side electrode 52 and the atmosphere side electrode 53 changes due to a change in the oxygen concentration ratio between the two side surfaces of the solid electrolyte layer 51.

Therefore, if the exhaust air-fuel ratio becomes the stoichiometric air-fuel ratio and no change occurs in the oxygen concentration ratio between the two side surfaces of the solid electrolyte layer 51, the oxygen concentration ratio between the two side surfaces of the solid electrolyte layer 51 becomes an oxygen concentration ratio corresponding to the sensor applied voltage Vr. In this case, the electromotive force E matches the sensor applied voltage Vr, and the potential difference Vs between the exhaust side electrode 52 and the atmosphere side electrode 53 becomes the sensor applied voltage Vr. As a result, current Ir does not flow.

On the other hand, if the exhaust air-fuel ratio becomes an air-fuel ratio different from the stoichiometric air-fuel ratio and a change occurs in the oxygen concentration ratio between the two side surfaces of the solid electrolyte layer 51, the oxygen concentration ratio between the two side surfaces of the solid electrolyte layer 51 does not become an oxygen concentration ratio corresponding to the sensor applied voltage Vr. In this case, the electromotive force E becomes a value different from the sensor applied voltage Vr. For this reason, due to negative feedback control, a potential difference Vs is given between the exhaust side electrode 52 and the atmosphere side electrode 53 so as to make oxygen ions move between the two side surfaces of the solid electrolyte layer 51 so that the electromotive force E matches the sensor applied voltage Vr. Further, a current Ir flows along with movement of oxygen ions at this time. As a result of this, the electromotive force E converges to the sensor applied voltage Vr. If the electromotive force E converges to the sensor applied voltage Vr, finally, the potential difference Vs also converges to the sensor applied voltage Vr.

Therefore, the voltage applying device 60 can be said to substantially apply the sensor applied voltage Vr between the exhaust side electrode 52 and the atmosphere side electrode 53. Note that, the electrical circuit of the voltage applying device 60 does not necessarily have to be one such as shown in FIG. 6. The device may be any type so long as able to substantially apply the sensor applied voltage Vr between the exhaust side electrode 52 and the atmosphere side electrode 53.

Further, the current detection device 61 does not actually detect the current. It detects the voltage $E_0$ and calculates the current from this voltage $E_0$. Here, $E_0$ is expressed by the following formula (1).

$$E_0 = Vr + V_0 + IrR \quad (1)$$

Here, $V_0$ is the offset voltage (voltage applied so that $E_0$ does not become negative value, for example, 3V), and R is the value of the resistance shown in FIG. 6.

In formula (1), the sensor applied voltage Vr, offset voltage $V_0$, and resistance value R are constant, so the voltage $E_0$ changes according to the current Ir. For this reason, if detecting the voltage $E_0$, it is possible to calculate the current Ir from that voltage $E_0$.

Therefore, the current detection device 61 can be said to substantially detect the current Ir flowing between the exhaust side electrode 52 and the atmosphere side electrode 53. Note that, the electrical circuit of the current detection device 61 does not necessarily have to be one such as shown in FIG. 6. The device may be any type so long as able to detect the current Ir flowing between the exhaust side electrode 52 and the atmosphere side electrode 53.

<Summary of Normal Operation Control>

Next, a summary of the air-fuel ratio control in the control system of an internal combustion engine of the present embodiment will be explained. First, the normal operation control for determining the fuel injection amount so that the gas air-fuel ratio is made to match the target air-fuel ratio in the internal combustion engine will be explained. The control system of an internal combustion engine is provided with an inflowing air-fuel ratio control means for adjusting the air-fuel ratio of the exhaust gas flowing into the exhaust purification catalyst. The inflowing air-fuel ratio control means of the present embodiment adjusts the amount of fuel supplied to a combustion chamber to thereby adjust the air-fuel ratio of the exhaust gas flowing into the exhaust purification catalyst. The inflowing air-fuel ratio control means is not limited to this. It is possible to employ any device able to adjust the air-fuel ratio of the exhaust gas flowing into the exhaust purification catalyst. For example, the inflowing air-fuel ratio control means may comprise an EGR (exhaust gas recirculation) device for recirculating exhaust gas to the engine intake passage and be formed so as to adjust the amount of recirculated gas.

The internal combustion engine of the present embodiment uses the output current Irup of the upstream side air-fuel ratio sensor 40 as the basis for feedback control so that the output current Irup of the upstream side air-fuel ratio sensor 40 (that is, the air-fuel ratio of the exhaust gas flowing into the exhaust purification catalyst) becomes a value corresponding to the target air-fuel ratio.

The target air-fuel ratio is set based on the output current of the downstream side air-fuel ratio sensor 41. Specifically, when the output current Irdwn of the downstream side air-fuel ratio sensor 41 becomes a rich judgment reference value Iref or less, the target air-fuel ratio is made a lean set air-fuel ratio and is maintained at that air-fuel ratio. Here, as the rich judgment reference value Iref, it is possible to use a value corresponding to a predetermined rich judged air-fuel ratio (for example, 14.55) slightly richer than the stoichiometric air-fuel ratio. Further, the lean set air-fuel ratio is a predetermined air-fuel ratio a certain extent leaner than the stoichiometric air-fuel ratio, for example, is made 14.65 to 20, preferably 14.65 to 18, more preferably 14.65 to 16 or so.

The control system of an internal combustion engine of the present embodiment is provided with an oxygen storage amount acquiring means for acquiring the amount of oxygen stored in the exhaust purification catalyst. When the target air-fuel ratio is the lean set air-fuel ratio, an oxygen storage amount OSAsc of the upstream side exhaust purification catalyst 20 is estimated. Further, in the present embodiment, the oxygen storage amount OSAsc of the upstream side exhaust purification catalyst 20 is estimated even when the target air-fuel ratio is the rich set air-fuel ratio. The oxygen storage amount OSAsc is estimated based on the output current Irup of the upstream side air-fuel ratio sensor 40, the estimated value of the intake air amount to the combustion chamber 5 calculated based on the air flowmeter 39 etc., the fuel injection amount from the fuel injector 11, etc. Further, during the time period when control is performed so that the target air-fuel ratio is set to the lean set air-fuel ratio, if the estimated value of the oxygen storage amount OSAsc becomes a predetermined judgment reference storage amount Cref or more, the target air-fuel ratio which had been the lean set air-fuel ratio up to then is made a rich set air-fuel ratio and is maintained at that air-fuel ratio. In the present embodiment, the weak rich set air-fuel ratio is employed. The weak rich set air-fuel ratio is slightly richer than the stoichiometric air-fuel ratio, for example, is made 13.5 to 14.58, preferably 14 to 14.57, more preferably 14.3 to 14.55 or so. After that, when the output current Irdwn of the downstream side air-fuel ratio sensor 41 again becomes the rich judgment reference value Iref or less, the target air-fuel ratio is again made the lean set air-fuel ratio and, after that, a similar operation is repeated.

In this way, in the present embodiment, the target air-fuel ratio of the exhaust gas flowing into the upstream side exhaust purification catalyst 20 is alternately set to the lean set air-fuel ratio and the weak rich set air-fuel ratio. In particular, in the present embodiment, the difference of the lean set air-fuel ratio from the stoichiometric air-fuel ratio is larger than the difference of the weak rich set air-fuel ratio from the stoichiometric air-fuel ratio. Therefore, in the present embodiment, the target air-fuel ratio is alternately set to a lean set air-fuel ratio of a short time period and a weak rich set air-fuel ratio of a long time period.

Note that, the difference of the lean set air-fuel ratio from the stoichiometric air-fuel ratio may be substantially the same as the difference of the rich set air-fuel ratio from the stoichiometric air-fuel ratio. That is, the depth of the rich set air-fuel ratio and the depth of the lean set air-fuel ratio may become substantially equal. In such a case, the time period of the lean set air-fuel ratio and the time period of the rich set air-fuel ratio become substantially the same lengths.

<Explanation of Control Using Time Chart>

Figure 7:
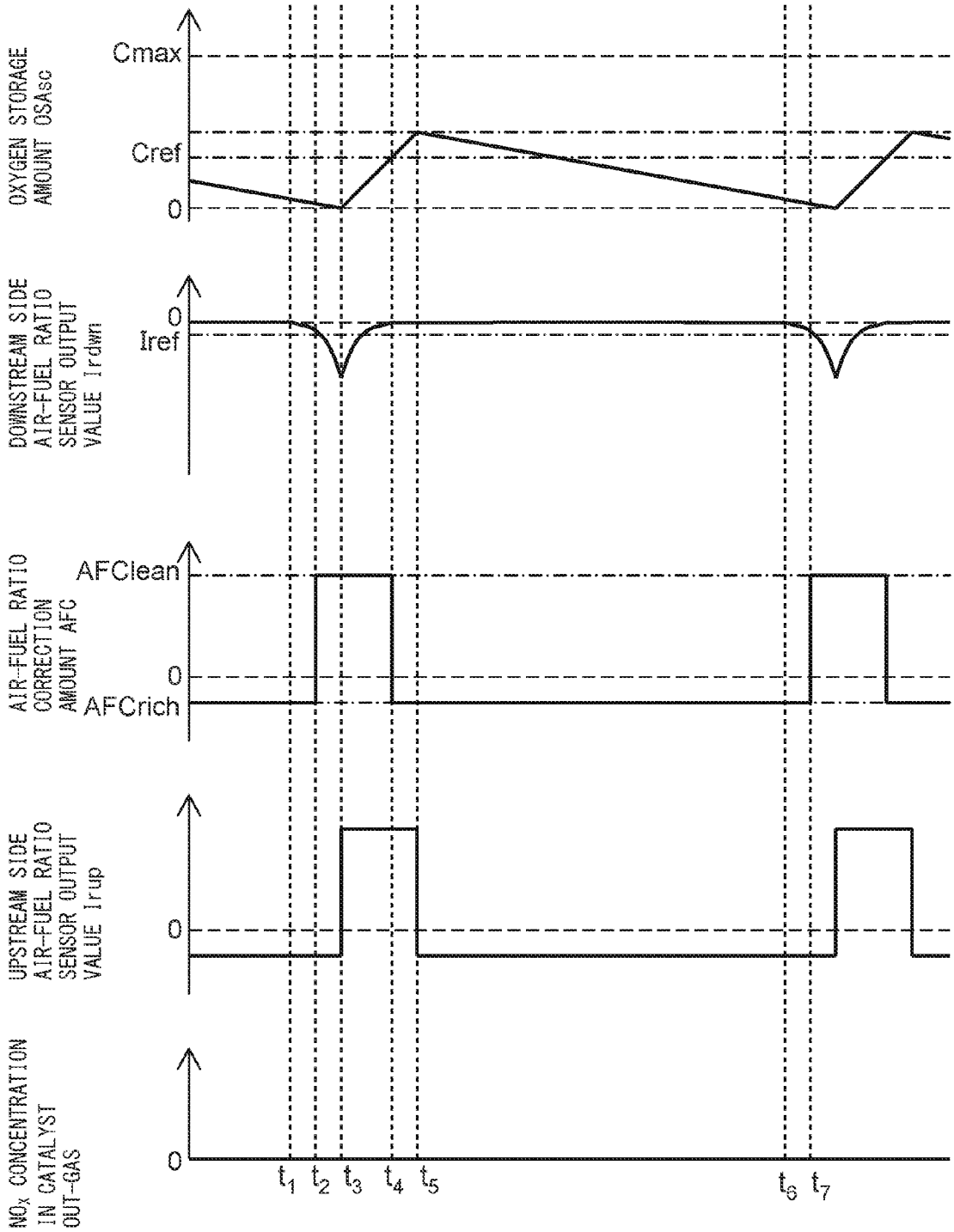
FIG. 7 A time chart of an oxygen storage amount of an upstream side exhaust purification catalyst etc.

FIG. 7 shows a time chart of a first normal operation control in the present embodiment. FIG. 7 is a time chart of parameters in the case of performing air-fuel ratio control in a control system of an internal combustion engine of the present invention such as the oxygen storage amount OSAsc of the upstream side exhaust purification catalyst 20, output current Irdwn of the downstream side air-fuel ratio sensor 41, air-fuel ratio correction amount AFC, output current Irup of the upstream side air-fuel ratio sensor 40, and concentration of $NO_X$ in the exhaust gas flowing out from the upstream side exhaust purification catalyst 20.

Note that, the output current Irup of the upstream side air-fuel ratio sensor 40 becomes zero when the air-fuel ratio of the exhaust gas flowing into the upstream side exhaust purification catalyst 20 is the stoichiometric air-fuel ratio, becomes a negative value when the air-fuel ratio of the exhaust gas is a rich air-fuel ratio, and becomes a positive value when the air-fuel ratio of the exhaust gas is a lean air-fuel ratio. Further, when the air-fuel ratio of the exhaust gas flowing into the upstream side exhaust purification catalyst 20 is the rich air-fuel ratio or lean air-fuel ratio, the greater the difference from the stoichiometric air-fuel ratio, the greater the absolute value of the output current Irup of the upstream side air-fuel ratio sensor 40. The output current Irdwn of the downstream side air-fuel ratio sensor 41 also changes according to the air-fuel ratio of the exhaust gas flowing out from the upstream side exhaust purification catalyst 20 in the same way as the output current Irup of the upstream side air-fuel ratio sensor 40. Further, the air-fuel ratio correction amount AFC is the correction amount relating to the target air-fuel ratio of the exhaust gas flowing into the upstream side exhaust purification catalyst 20. When the air-fuel ratio correction amount AFC is 0, the target air-fuel ratio is made the stoichiometric air-fuel ratio, when the air-fuel ratio correction amount AFC is a positive value, the target air-fuel ratio becomes a lean air-fuel ratio, and when the air-fuel ratio correction amount AFC is a negative value, the target air-fuel ratio becomes the rich air-fuel ratio.

In the illustrated example, in the state before the time $t_1$, the air-fuel ratio correction amount AFC is made the weak rich set correction amount AFCrich. The weak rich set correction amount AFCrich is a value corresponding to the weak rich set air-fuel ratio and a value smaller than 0. Therefore, the target air-fuel ratio is made the rich air-fuel ratio. Along with this, the output current Irup of the upstream side air-fuel ratio sensor 40 becomes a negative value. If the exhaust gas flowing into the upstream side exhaust purification catalyst 20 starts to contain unburned gas, the oxygen storage amount OSAsc of the upstream side exhaust purification catalyst 20 gradually decreases. However, the unburned gas contained in the exhaust gas is removed at the upstream side exhaust purification catalyst 20, so the downstream side output current Irdwn of the air-fuel ratio sensor becomes substantially 0 (corresponding to stoichiometric air-fuel ratio). At this time, the air-fuel ratio of the exhaust gas flowing into the upstream side exhaust purification catalyst 20 becomes the rich air-fuel ratio, so the amount of discharge of $NO_X$ of the upstream side exhaust purification catalyst 20 is kept down.

If the oxygen storage amount OSAsc of the upstream side exhaust purification catalyst 20 gradually decreases, the oxygen storage amount OSAsc decreases below the lower limit storage amount (see Clowlim of FIG. 2B) at the time $t_1$. If the oxygen storage amount OSAsc decreases from the lower limit storage amount, part of the unburned gas flowing into the upstream side exhaust purification catalyst 20 flows out without being removed at the upstream side exhaust purification catalyst 20. For this reason, at the time $t_1$ on, along with the decrease of the oxygen storage amount OSAsc of the upstream side exhaust purification catalyst 20, the output current Irdwn of the downstream side air-fuel ratio sensor 41 gradually decreases. At this time as well, the air-fuel ratio of the exhaust gas flowing into the upstream side exhaust purification catalyst 20 becomes the rich air-fuel ratio, so the amount of discharge of $NO_X$ of the upstream side exhaust purification catalyst 20 is kept down.

After that, at the time $t_2$, the output current Irdwn of the downstream side air-fuel ratio sensor 41 reaches the rich judgment reference value Iref corresponding to the rich judged air-fuel ratio. In the present embodiment, if the output current Irdwn of the downstream side air-fuel ratio sensor 41 becomes the rich judgment reference value Iref, the decrease of the oxygen storage amount OSAsc of the upstream side exhaust purification catalyst 20 is kept down by the air-fuel ratio correction amount AFC being switched to the lean set correction amount AFClean. The lean set correction amount AFClean is a value corresponding to the lean set air-fuel ratio and is a value larger than 0. Therefore, the target air-fuel ratio is made the lean air-fuel ratio.

Note that, in the present embodiment, the air-fuel ratio correction amount AFC is switched after the output current Irdwn of the downstream side air-fuel ratio sensor 41 reaches the rich judgment reference value Iref, that is, after the air-fuel ratio of the exhaust gas flowing out from the upstream side exhaust purification catalyst 20 reaches the rich judged air-fuel ratio. This is because even if the oxygen storage amount of the upstream side exhaust purification catalyst 20 is sufficient, sometimes the air-fuel ratio of the exhaust gas flowing out from the upstream side exhaust purification catalyst 20 ends up deviating from the stoichiometric air-fuel ratio very slightly. That is, if ending up judging that the oxygen storage amount has decreased below the lower limit storage amount even if the output current Irdwn deviates from zero (corresponding to stoichiometric air-fuel ratio) slightly, there is a possibility that it will be judged that the oxygen storage amount has decreased below the lower limit storage amount even if there is actually a sufficient oxygen storage amount. Therefore, in the present embodiment, it is judged that the oxygen storage amount has decreased below the lower limit storage amount only after the air-fuel ratio of the exhaust gas flowing out from the upstream side exhaust purification catalyst 20 reaches the rich judged air-fuel ratio. Conversely speaking, the rich judged air-fuel ratio is made an air-fuel ratio which the air-fuel ratio of the exhaust gas flowing out from the upstream side exhaust purification catalyst 20 will not reach when the oxygen storage amount of the upstream side exhaust purification catalyst 20 is sufficient.

Even if, at the time $t_2$, switching the target air-fuel ratio to the lean air-fuel ratio, the air-fuel ratio of the exhaust gas flowing into the upstream side exhaust purification catalyst 20 does not immediately become the lean air-fuel ratio and a certain extent of delay occurs. As a result, the air-fuel ratio of the exhaust gas flowing into the upstream side exhaust purification catalyst 20 changes from the rich air-fuel ratio to the lean air-fuel ratio at the time $t_3$. Note that, at the times $t_2$ to $t_3$, the air-fuel ratio of the exhaust gas flowing out from the upstream side exhaust purification catalyst 20 becomes the rich air-fuel ratio, so this exhaust gas starts to contain unburned gas. However, the amount of discharge of $NO_X$ of the upstream side exhaust purification catalyst 20 is suppressed.

If, at the time $t_3$, the air-fuel ratio of the exhaust gas flowing into the upstream side exhaust purification catalyst 20 changes to the lean air-fuel ratio, the oxygen storage amount OSAsc of the upstream side exhaust purification catalyst 20 increases. Further, along with this, the air-fuel ratio of the exhaust gas flowing out from the upstream side exhaust purification catalyst 20 changes to the stoichiometric air-fuel ratio and the output current Irdwn of the downstream side air-fuel ratio sensor 41 also converges to 0. At this time, the air-fuel ratio of the exhaust gas flowing into the upstream side exhaust purification catalyst 20 becomes the lean air-fuel ratio, so there is sufficient extra margin in the oxygen storage ability of the upstream side exhaust purification catalyst 20, so the oxygen in the inflowing exhaust gas is stored in the upstream side exhaust purification catalyst 20 and $NO_X$ is removed by reduction. For this reason, the amount of discharge of $NO_X$ of the upstream side exhaust purification catalyst 20 is kept down.

After that, if the oxygen storage amount OSAsc of the upstream side exhaust purification catalyst 20 increases, at the time $t_4$, the oxygen storage amount OSAsc reaches the judgment reference storage amount Cref. The judgement reference storage amount Cref is set to the maximum storable oxygen amount Cmax or less. In the present embodiment, if the oxygen storage amount OSAsc becomes the judgment reference storage amount Cref, the storage of oxygen in the upstream side exhaust purification catalyst 20 is made to stop by making the air-fuel ratio correction amount AFC switch to the weak rich set correction amount AFCrich (value smaller than 0). Therefore, the target air-fuel ratio is made the rich air-fuel ratio.

However, as explained above, a delay occurs from when switching the target air-fuel ratio to when the air-fuel ratio of the exhaust gas flowing into the upstream side exhaust purification catalyst 20 actually changes. For this reason, even if switching at the time $t_4$, the air-fuel ratio of the exhaust gas flowing into the upstream side exhaust purification catalyst 20 changes from the lean air-fuel ratio to the rich air-fuel ratio at the time $t_5$ after a certain extent of time elapses. At the times $t_4$ to $t_5$, the air-fuel ratio of the exhaust gas flowing into the upstream side exhaust purification catalyst 20 is the lean air-fuel ratio, so the oxygen storage amount OSAsc of the upstream side exhaust purification catalyst 20 increases.

However, the judgment reference storage amount Cref is set sufficiently lower than the maximum oxygen storage amount Cmax and the upper limit storage amount (see Cuplim of FIG. 2A), so even at the time $t_5$, the oxygen storage amount OSAsc does not reach the maximum oxygen storage amount Cmax or the upper limit storage amount. Conversely speaking, the judgment reference storage amount Cref is made an amount sufficiently small so that even if a delay occurs from when switching the target air-fuel ratio to when the air-fuel ratio of the exhaust gas flowing into the upstream side exhaust purification catalyst 20 actually changes, the oxygen storage amount OSAsc does not reach the maximum oxygen storage amount Cmax or the upper limit storage amount. For example, the judgment reference storage amount Cref is made ¾ or less of the maximum oxygen storage amount Cmax, preferably ½ or less, more preferably ⅕ or less. Therefore, at the times $t_4$ to $t_5$, the amount of discharge of $NO_X$ from the upstream side exhaust purification catalyst 20 is kept down.

At the time $t_5$ on, the air-fuel ratio correction amount AFC is made the weak rich set correction amount AFCrich. Therefore, the target air-fuel ratio is made the rich air-fuel ratio. Along with this, the output current Irup of the upstream side air-fuel ratio sensor 40 becomes a negative value. The exhaust gas flowing into the upstream side exhaust purification catalyst 20 starts to contain unburned gas, so the oxygen storage amount OSAsc of the upstream side exhaust purification catalyst 20 gradually decreases and, at the time $t_6$, in the same way as the time $t_1$, the oxygen storage amount OSAsc decreases below the lower limit storage amount. At this time as well, the air-fuel ratio of the exhaust gas flowing into the upstream side exhaust purification catalyst 20 is the rich air-fuel ratio, so the amount of discharge of $NO_X$ of the upstream side exhaust purification catalyst 20 is kept down.

Next, at the time $t_7$, in the same way as the time $t_2$, the output current Irdwn of the downstream side air-fuel ratio sensor 41 reaches the rich judgment reference value Iref corresponding to the rich judged air-fuel ratio. Due to this, the air-fuel ratio correction amount AFC is switched to the lean set correction amount AFClean corresponding to the lean set air-fuel ratio. After that, the cycle of the above-mentioned times $t_1$ to $t_6$ is repeated.

Note that, such control of the air-fuel ratio correction amount AFC is performed by the electronic control unit 31. Therefore, the electronic control unit 31 can be said to be provided with an oxygen storage amount increasing means for continuously making the target air-fuel ratio of the exhaust gas flowing into the upstream side exhaust purification catalyst 20 the lean set air-fuel ratio when the air-fuel ratio of the exhaust gas detected by the downstream side air-fuel ratio sensor 41 becomes the rich judged air-fuel ratio or less until the oxygen storage amount OSAsc of the upstream side exhaust purification catalyst 20 becomes the judgment reference storage amount Cref, and an oxygen storage amount decreasing means for continuously making the target air-fuel ratio the weak rich set air-fuel ratio when the oxygen storage amount OSAsc of the upstream side exhaust purification catalyst 20 becomes the judgment reference storage amount Cref or more so that the oxygen storage amount OSAsc decreases toward zero without reaching the maximum oxygen storage amount Cmax.

As will be understood from the above explanation, according to the present embodiment, it is possible to constantly keep down the amount of discharge of $NO_X$ from the upstream side exhaust purification catalyst 20. That is, so long as performing the above-mentioned control, basically it is possible to reduce the amount of discharge of $NO_X$ from the upstream side exhaust purification catalyst 20.

Further, in general, when the output current Irup of the upstream side air-fuel ratio sensor 40 and the estimated value of the intake air amount etc. are used as the basis to estimate the oxygen storage amount OSAsc, error may occur. In the present embodiment as well, the oxygen storage amount OSAsc is estimated over the times $t_3$ to $t_4$, so the estimated value of the oxygen storage amount OSAsc includes some error. However, even if such error is included, if setting the judgment reference storage amount Cref sufficiently lower than the maximum oxygen storage amount Cmax or the upper limit storage amount, the actual oxygen storage amount OSAsc almost never reaches the maximum oxygen storage amount Cmax or the upper limit storage amount. Therefore, from this viewpoint as well, it is possible to keep down the amount of discharge of $NO_X$ of the upstream side exhaust purification catalyst 20.

Further, if the oxygen storage amount of the exhaust purification catalyst is maintained constant, the oxygen storage ability of the exhaust purification catalyst will fall. As opposed to this, according to the present embodiment, the oxygen storage amount OSAsc constantly fluctuates up and down, so the oxygen storage ability is kept from falling.

Note that, in the above embodiment, at the times $t_2$ to $t_4$, the air-fuel ratio correction amount AFC is maintained at the lean set correction amount AFClean. However, in this time period, the air-fuel ratio correction amount AFC does not necessarily have to be maintained constant. It may also be set so as to fluctuate such as so as to gradually decrease. In the same way, at the times $t_4$ to $t_7$, the air-fuel ratio correction amount AFC is maintained at the weak rich set correction amount AFCrich. However, in this time period, the air-fuel ratio correction amount AFC does not necessarily have to be maintained constant. It may also be set so as to fluctuate such as so as to gradually decrease.

However, in this case as well, the air-fuel ratio correction amount AFC at the times $t_2$ to $t_4$ may be set so that the difference between the average value of the target air-fuel ratio at that time period and the stoichiometric air-fuel ratio becomes larger than the difference between the average value of the target air-fuel ratio at the times $t_4$ to $t_7$ and the stoichiometric air-fuel ratio.

Further, in the above embodiment, the output current Irup of the upstream side air-fuel ratio sensor 40 and the estimated value of the intake air amount to a combustion chamber 5 etc. are used as the basis to estimate the oxygen storage amount OSAsc of the upstream side exhaust purification catalyst 20. However, the oxygen storage amount OSAsc may also be calculated based on other parameters besides these parameters. Parameters different from these parameters may also be used as the basis for estimation. Further, in the above embodiment, if the estimated value of the oxygen storage amount OSAsc becomes a judgment reference storage amount Cref or more, the target air-fuel ratio is switched from the lean set air-fuel ratio to the weak rich set air-fuel ratio. However, the timing for switching the target air-fuel ratio from the lean set air-fuel ratio to the weak rich set air-fuel ratio may, for example, also be based on the engine operating time from when switching the target air-fuel ratio from the weak rich set air-fuel ratio to the lean set air-fuel ratio or another parameter. However, in this case as well, the target air-fuel ratio has to be switched from the lean set air-fuel ratio to the weak rich set air-fuel ratio while the oxygen storage amount OSAsc of the upstream side exhaust purification catalyst 20 is estimated as being smaller than the maximum oxygen storage amount.

<Explanation of Control Using Downstream Side Catalyst>

Further, in the present embodiment, in addition to the upstream side exhaust purification catalyst 20, a downstream side exhaust purification catalyst 24 is also provided. The oxygen storage amount OSAufc of the downstream side exhaust purification catalyst 24 is made a value near the maximum oxygen storage amount Cmax by fuel cut (F/C) control performed every certain extent of time period. For this reason, even if exhaust gas containing unburned gas flows out from the upstream side exhaust purification catalyst 20, the unburned gas is removed by oxidation at the downstream side exhaust purification catalyst 24.

Here, "fuel cut control" is control for stopping the injection of fuel from the fuel injector 11 at the time of deceleration of the vehicle mounting the internal combustion engine etc. even in a state where the crankshaft and piston 3 are moving. If performing this control, a large amount of air flows into the exhaust purification catalyst 20 and exhaust purification catalyst 24.

Figure 8:
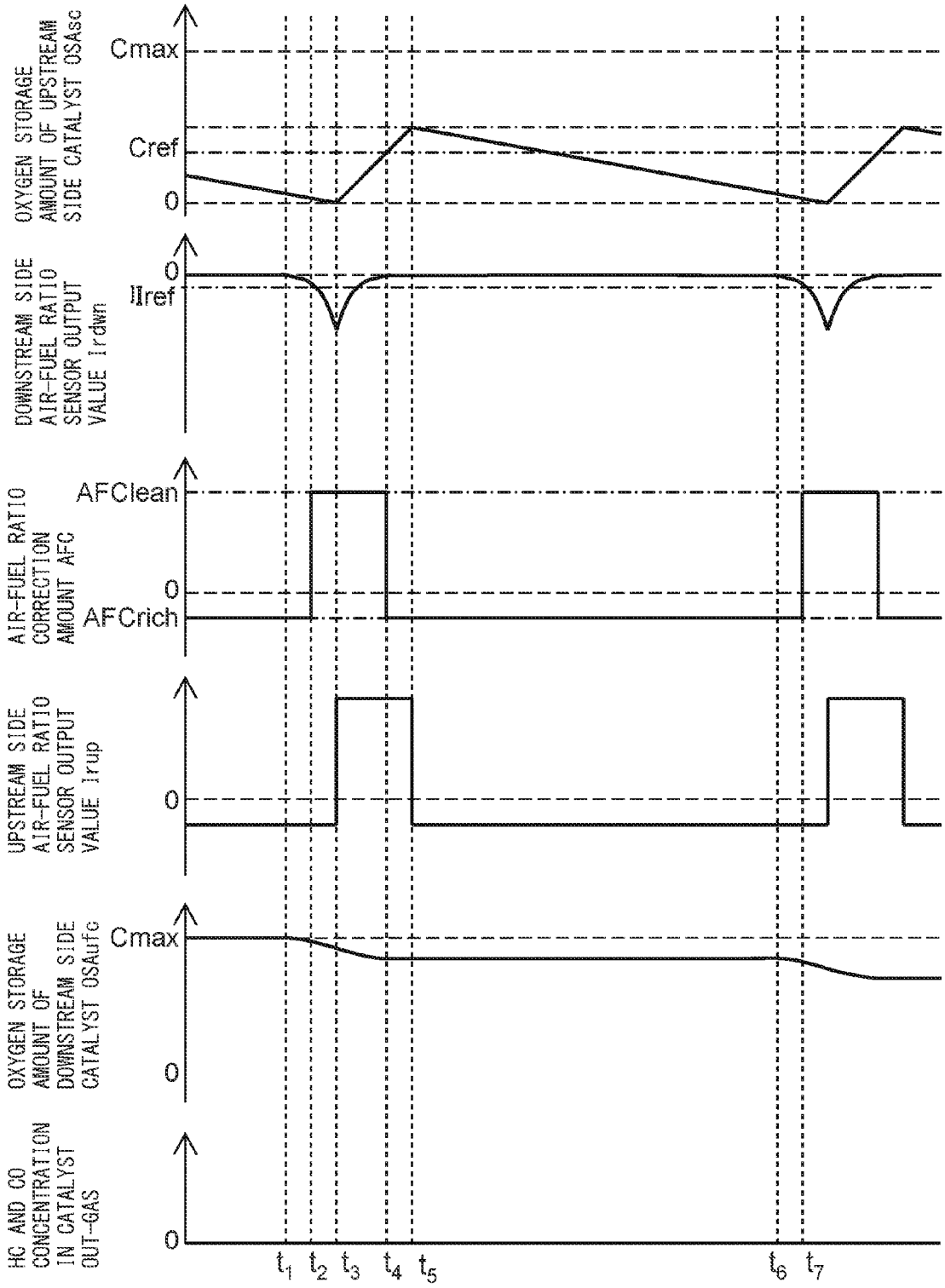
FIG. 8 A time chart of an oxygen storage amount of a downstream side exhaust purification catalyst etc.

Below, referring to FIG. 8, the trend in the oxygen storage amount OSAufc at the downstream side exhaust purification catalyst 24 will be explained. FIG. 8 is a view similar to FIG. 7. Instead of the concentration of $NO_X$ of FIG. 7, this shows the trends in the oxygen storage amount OSAufc of the downstream side exhaust purification catalyst 24 and the concentration of the unburned gas in the exhaust gas (HC, CO, etc. flowing out from the downstream side exhaust purification catalyst 24. Further, in the example shown in FIG. 8, control the same as the example shown in FIG. 7 is performed.

In the example shown in FIG. 8, before the time $t_1$, fuel cut control is performed. For this reason, before the time $t_1$, the oxygen storage amount OSAufc of the downstream side exhaust purification catalyst 24 becomes a value near the maximum oxygen storage amount Cmax. Further, before the time $t_1$, the air-fuel ratio of the exhaust gas flowing out from the upstream side exhaust purification catalyst 20 is maintained at substantially the stoichiometric air-fuel ratio. For this reason, the oxygen storage amount OSAufc of the downstream side exhaust purification catalyst 24 is maintained constant.

After that, at the times $t_1$ to $t_4$, the air-fuel ratio of the exhaust gas flowing out from the upstream side exhaust purification catalyst 20 becomes the rich air-fuel ratio. For this reason, exhaust gas including unburned gas flows into the downstream side exhaust purification catalyst 24.

As explained above, the downstream side exhaust purification catalyst 24 stores a large amount of oxygen, so if the exhaust gas flowing into the downstream side exhaust purification catalyst 24 contains unburned gas, the stored oxygen enables the unburned gas to be removed by oxidation. Further, along with this, the oxygen storage amount OSAufc of the downstream side exhaust purification catalyst 24 will decrease. However, at the times $t_1$ to $t_4$, the unburned gas flowing out from the upstream side exhaust purification catalyst 20 does not become that great, so the amount of decrease of the oxygen storage amount OSAufc during this period is slight. For this reason, at the times $t_1$ to $t_4$, the unburned gas flowing out from the upstream side exhaust purification catalyst 20 is all removed by reduction at the downstream side exhaust purification catalyst 24.

At the time $t_6$ on as well, every certain extent of time interval, in the same way as the case at the times $t_1$ to $t_4$, unburned gas flows out from the upstream side exhaust purification catalyst 20. The thus flowing out unburned gas is basically removed by reduction by the oxygen stored in the downstream side exhaust purification catalyst 24. Therefore, almost no unburned gas flows out from the downstream side exhaust purification catalyst 24. As explained above, if considering the fact that the amount of discharge of $NO_X$ of the upstream side exhaust purification catalyst 20 is made small, according to the present embodiment, the amounts of discharge of unburned gas and $NO_X$ from the downstream side exhaust purification catalyst 24 are made constantly small.

<Specific Explanation of Control>

Figure 9:
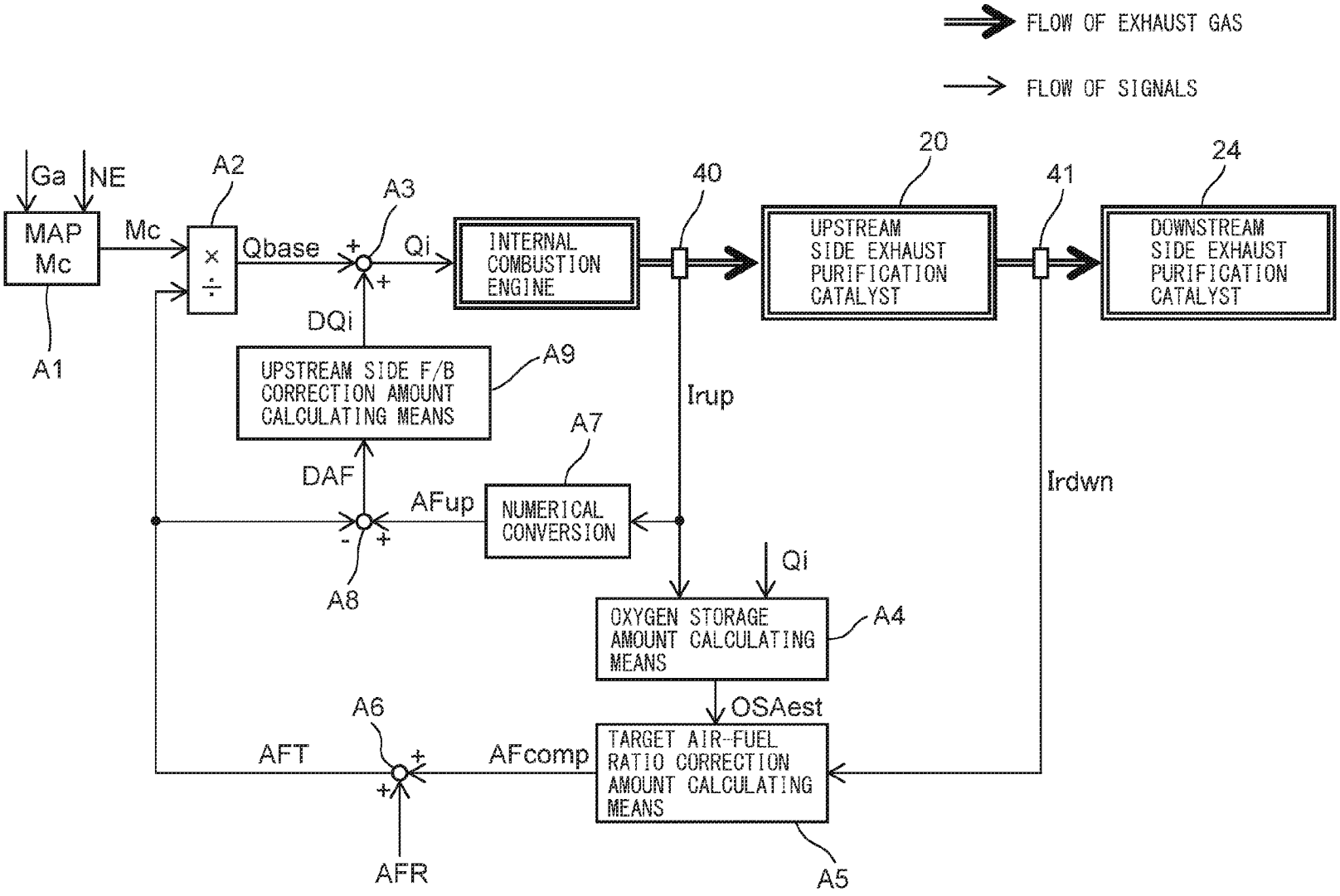
FIG. 9 A functional block diagram of a control system.
Figure 10:
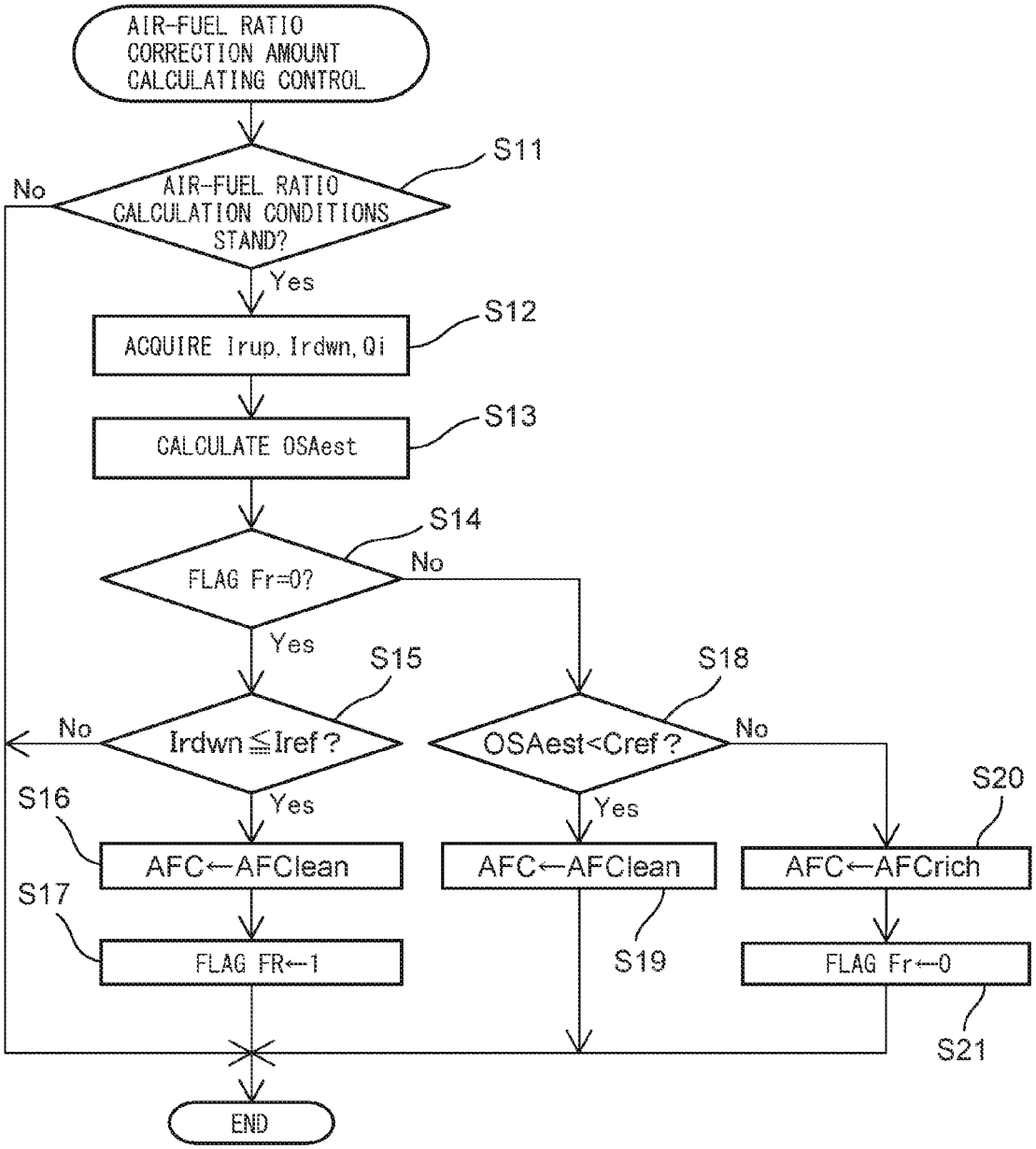
FIG. 10 A flow chart showing a control routine calculating an air-fuel ratio correction amount in first normal operation control in an embodiment.

Next, referring to FIG. 9 and FIG. 10, the control system in the above embodiment will be specifically explained. The control system in the present embodiment is, as shown in the functional block diagram of FIG. 9, configured including the functional blocks A1 to A9. Below, while referring to FIG. 9, the functional blocks will be explained.

<Calculation of Fuel Injection Amount>

First, calculation of the fuel injection amount will be explained. In calculating the fuel injection amount, a cylinder intake air amount calculating means A1 functioning as a cylinder intake air amount calculating part, a basic fuel injection amount calculating means A2 functioning as a basic fuel injection amount calculating part, and a fuel injection amount calculating means A3 functioning as a fuel injection amount calculating part are used.

The cylinder intake air amount calculating means A1 uses an intake air flow rate Ga measured by the air flowmeter 39, an engine speed NE calculated based on the output of the crank angle sensor 44, and a map or calculation formula stored in the ROM 34 of the electronic control unit 31 as the basis to calculate the intake air amount Mc to each cylinder.

The basic fuel injection amount calculating means A2 divides the cylinder intake air amount Mc calculated by the cylinder intake air amount calculating means A1 by the target air-fuel ratio AFT calculated by the later explained target air-fuel ratio setting means A6 to thereby calculate the basic fuel injection amount Qbase (Qbase=Mc/AFT).

The fuel injection amount calculating means A3 adds the later explained F/B correction amount DQi to the basic fuel injection amount Qbase calculated by the basic fuel injection amount calculating means A2 to thereby calculate the fuel injection amount Qi (Qi=Qbase+DQi). The fuel injector 11 is given an injection command so that the thus calculated fuel injection amount Qi of fuel is injected from the fuel injector 11.

<Calculation of Target Air-Fuel Ratio>

Next, the calculation of the target air-fuel ratio will be explained. In calculation of the target air-fuel ratio, the oxygen storage amount acquiring means is used as the oxygen storage amount acquiring part. In calculating the target air-fuel ratio, the oxygen storage amount calculating means A4 functioning as the oxygen storage amount acquiring part, the target air-fuel ratio correction amount calculating means A5 functioning as the target air-fuel ratio correction amount calculating part, and the target air-fuel ratio setting means A6 functioning as the target air-fuel ratio setting part are used.

The oxygen storage amount calculating means A4 uses the fuel injection amount Qi calculated by the fuel injection amount calculating means A3 and the output current Irup of the upstream side air-fuel ratio sensor 40 as the basis to calculate the estimated value OSAest of the oxygen storage amount of the upstream side exhaust purification catalyst 20. For example, the oxygen storage amount calculating means A4 multiplies the difference between the air-fuel ratio corresponding to the output current Irup of the upstream side air-fuel ratio sensor 40 and the stoichiometric air-fuel ratio with the fuel injection amount Qi, and cumulatively adds the calculated values to calculate the estimated value OSAest of the oxygen storage amount. Note that, the oxygen storage amount of the upstream side exhaust purification catalyst 20 need not be estimated by the oxygen storage amount calculating means A4 constantly. For example, the oxygen storage amount may be estimated only for the period from when the target air-fuel ratio is actually switched from the rich air-fuel ratio to the lean air-fuel ratio (time $t_3$ at FIG. 7) to when the estimated value OSAest of the oxygen storage amount reaches the judgment reference storage amount Cref (time $t_4$ at FIG. 7).

The target air-fuel ratio correction amount calculating means A5 uses the estimated value OSAest of the oxygen storage amount calculated by the oxygen storage amount calculating means A4 and the output current Irdwn of the downstream side air-fuel ratio sensor 41 as the basis to calculate the air-fuel ratio correction amount AFC of the target air-fuel ratio. Specifically, the air-fuel ratio correction amount AFC is made the lean set correction amount AFClean when the output current Irdwn of the downstream side air-fuel ratio sensor 41 becomes the rich judgment reference value Iref (value corresponding to rich judged air-fuel ratio) or less. After that, the air-fuel ratio correction amount AFC is maintained at the lean set correction amount AFClean until the estimated value OSAest of the oxygen storage amount reaches the judgment reference storage amount Cref. If the estimated value OSAest of the oxygen storage amount reaches the judgment reference storage amount Cref, the air-fuel ratio correction amount AFC is made the weak rich set correction amount AFCrich. After that, the air-fuel ratio correction amount AFC is maintained at the weak rich set correction amount AFCrich until the output current Irdwn of the downstream side air-fuel ratio sensor 41 becomes the rich judgment reference value Iref (value corresponding to rich judged air-fuel ratio).

The target air-fuel ratio setting means A6 calculates the target air-fuel ratio AFT by adding an air-fuel ratio correction amount AFC calculated by the target air-fuel ratio correction amount calculating means A5 to the reference air-fuel ratio, in the present embodiment, the stoichiometric air-fuel ratio AFR. Therefore, the target air-fuel ratio AFT is made either the weak rich set air-fuel ratio (when the air-fuel ratio correction amount AFC is the weak rich set correction amount AFCrich) or the lean set air-fuel ratio (when the air-fuel ratio correction amount AFC is the lean set correction amount AFClean). The thus calculated target air-fuel ratio AFT is input to the basic fuel injection amount calculating means A2 and the later explained air-fuel ratio difference calculating means A8.

FIG. 10 is a flow chart showing a control routine of control for calculating the air-fuel ratio correction amount AFC. The illustrated control routine is performed by interruption at constant time intervals.

As shown in FIG. 10, first, at step S11, it is judged if the condition for calculation of the air-fuel ratio correction amount AFC stands. The case where the condition for calculation of the air-fuel ratio correction amount stands is, for example, when fuel cut control is not underway etc. If at step S11 it is judged that the condition for calculation of the target air-fuel ratio stands, the routine proceeds to step S12. At step S12, the output current Irup of the upstream side air-fuel ratio sensor 40, the output current Irdwn of the downstream side air-fuel ratio sensor 41, and the fuel injection amount Qi are obtained. At the next step S13, the output current Irup of the upstream side air-fuel ratio sensor 40 and the fuel injection amount Qi obtained at step S12 are used as the basis to calculate the estimated value OSAest of the oxygen storage amount.

Next, at step S14, it is judged if the lean set flag Fr is set to "0". The lean set flag Fr is set to "1" if the air-fuel ratio correction amount AFC is set to the lean set correction amount AFClean and is set to "0" otherwise. When at step S14 the lean set flag Fr is set to "0", the routine proceeds to step S15. At step S15, it is judged if the output current Irdwn of the downstream side air-fuel ratio sensor 41 is the rich judgment reference value Iref or less. If it is judged that the output current Irdwn of the downstream side air-fuel ratio sensor 41 is larger than the rich judgment reference value Iref, the control routine is made to end.

On the other hand, if the oxygen storage amount OSAsc of the upstream side exhaust purification catalyst 20 decreases and the air-fuel ratio of the exhaust gas flowing out from the upstream side exhaust purification catalyst 20 falls, at step S15, it is judged that the output current Irdwn of the downstream side air-fuel ratio sensor 41 is the rich judgment reference value Iref or less. In this case, the routine proceeds to step S16 where air-fuel ratio correction amount AFC is made the lean set correction amount AFClean. Next, at step S17, the lean set flag Fr is set to "1", and the control routine is made to end.

At the next control routine, at step S14, it is judged that the lean set flag Fr has not been set to "0" and the routine proceeds to step S18. At step S18, it is judged if the estimated value OSAest of the oxygen storage amount calculated at step S13 is smaller than the judgment reference storage amount Cref. When it is judged that the estimated value OSAest of the oxygen storage amount is smaller than the judgment reference storage amount Cref, the routine proceeds to step S19 where the air-fuel ratio correction amount AFC continues to be made the lean set correction amount AFClean. On the other hand, if the oxygen storage amount of the upstream side exhaust purification catalyst 20 increases, finally at step S18 it is judged that the estimated value OSAest of the oxygen storage amount is the judgment reference storage amount Cref or more and the routine proceeds to step S20. At step S20, the air-fuel ratio correction amount AFC is made the weak rich set correction amount AFCrich, next, at step S21, the lean set flag Fr is reset to 0, then the control routine is made to end.

<Calculation of F/B Correction Amount>

Next, returning to FIG. 9, the calculation of the F/B correction amount based on the output current Irup of the upstream side air-fuel ratio sensor 40 will be explained. In calculation of the F/B correction amount, a numerical value converting part constituted by the numerical value converting means A7, an air-fuel ratio difference calculating part constituted by the air-fuel ratio difference calculating means A8, and a F/B correction amount calculating part constituted by the F/B correction amount calculating means A9 are used.

The numerical value converting means A7 uses the output current Irup of the upstream side air-fuel ratio sensor 40 and a map or calculation formula (for example, the map such as shown in FIG. 5) defining the relationship between the output current Irup of the upstream side air-fuel ratio sensor 40 and the air-fuel ratio as the basis to calculate the upstream side exhaust air-fuel ratio AFup corresponding to the output current Irup. Therefore, the upstream side exhaust air-fuel ratio AFup corresponds to the air-fuel ratio of the exhaust gas flowing into the upstream side exhaust purification catalyst 20.

The air-fuel ratio difference calculating means A8 subtracts from the upstream side exhaust air-fuel ratio AFup calculated by the numerical value converting means A7 the target air-fuel ratio AFT calculated by the target air-fuel ratio setting means A6 to thereby calculate the air-fuel ratio difference DAF (DAF=AFup-AFT). This air-fuel ratio difference DAF is a value expressing the excess/deficiency of the amount of fuel fed with respect to the target air-fuel ratio AFT.

The F/B correction calculating means A9 processes the air-fuel ratio difference DAF calculated by the air-fuel ratio difference calculating means A8 by proportional-integral-differential (PID) processing to calculate the F/B correction amount DFi for compensating for the excess/deficiency of the amount of feed of fuel based on the following formula (2). The thus calculated F/B correction amount DFi is input to the fuel injection calculating means A3.

$$DFi=Kp\cdot DAF+Ki\cdot SDAF+Kd\cdot DDAF \quad (2)$$

Note that, in the above formula (2), Kp is a preset proportional gain (proportional constant), Ki is a preset integral gain (integral constant), and Kd is a preset differential gain (differential constant). Further, DDAF is the time differential of the air-fuel ratio difference DAF and is calculated by dividing the difference between the currently updated air-fuel ratio difference DAF and the previously updated air-fuel ratio difference DAF by the time corresponding to the updating interval. Further, SDAF is the time integral of the air-fuel ratio difference DAF. This time integral DDAF is calculated by adding the previously updated time integral DDAF and the currently updated air-fuel ratio difference DAF (SDAF=DDAF+DAF).

Note that, in the above embodiment, the air-fuel ratio of the exhaust gas flowing into the upstream side exhaust purification catalyst 20 is detected by the upstream side air-fuel ratio sensor 40. However, the precision of detection of the air-fuel ratio of the exhaust gas flowing into the upstream side exhaust purification catalyst 20 does not necessarily have to be high, so, for example, the fuel injection amount from the fuel injector 11 and the output of the air flowmeter 39 may be used as the basis to estimate the air-fuel ratio of the exhaust gas.

In this way, in normal operation control, by performing control to make the air-fuel ratio of the exhaust gas flowing into the upstream side exhaust purification catalyst repeatedly the state of a rich air-fuel ratio and the state of a lean air-fuel ratio and further avoid the oxygen storage amount reaching the vicinity of the maximum oxygen storage amount, it is possible to keep $NO_X$ from flowing out. In the present embodiment, in normal operation control, control for making the air-fuel ratio of the exhaust gas flowing into the upstream side exhaust purification catalyst 20 a rich air-fuel ratio will be referred to as "rich control", while control for making the air-fuel ratio of the exhaust gas flowing into the exhaust purification catalyst 20 a lean air-fuel ratio will be referred to as the "lean control". That is, in normal operation control, rich control and lean control are repeatedly performed.

<Explanation of Lean Detection Mode Control>

In this regard, in the time period when the normal operation control is being performed, sometimes the deterioration of the exhaust purification catalyst along with time or deposition of hydrocarbons contained in the exhaust gas or poisoning by the sulfur ingredients causes the oxygen storage ability to decline. If the oxygen storage ability declines, sometimes the inside of the exhaust purification catalyst becomes a lean atmosphere. For example, when exhaust gas of a lean air-fuel ratio flows into the exhaust purification catalyst, sometimes oxygen cannot be sufficiently stored and the inside of the exhaust purification catalyst becomes a lean atmosphere. As a result, $NO_X$ is liable to be unable to be sufficiently removed. If the oxygen storage ability of the exhaust purification catalyst falls, the $NO_X$ removal ability permanently falls.

On the other hand, even if the oxygen storage ability of the exhaust purification catalyst is sufficient, sometimes the air-fuel ratio of the exhaust gas flowing into the exhaust purification catalyst becomes temporarily higher than the desired air-fuel ratio. For example, when accelerating or decelerating the engine along with the change in the requested load, sometimes the air-fuel ratio at the time of combustion in the combustion chamber is made to change. At the time of fluctuation of the air-fuel ratio at the time of combustion, sometimes disturbance of the air-fuel ratio at the time of combustion causes the air-fuel ratio to become leaner than the desired one. If the air-fuel ratio at the time of combustion becomes leaner than the desired air-fuel ratio, the air-fuel ratio of the exhaust gas flowing into the exhaust purification catalyst becomes leaner than the desired air-fuel ratio. As a result, the inside of the exhaust purification catalyst becomes a lean atmosphere and $NO_X$ is liable to be unable to be sufficiently removed.

If the inside of the exhaust purification catalyst 20 becomes a lean atmosphere, the air-fuel ratio of the exhaust gas flowing out from the exhaust purification catalyst 20 also becomes the lean air-fuel ratio. Therefore, the control system of an internal combustion engine of the present embodiment detects when the air-fuel ratio of the exhaust gas flowing out from the exhaust purification catalyst 20 becomes the lean air-fuel ratio during the time period of performing normal operation control and performs control for making the air-fuel ratio of the exhaust gas flowing into the exhaust purification catalyst 20 a rich air-fuel ratio richer than the stoichiometric air-fuel ratio. In the present embodiment, this control is called "lean detection mode control". In the lean detection mode control, the air-fuel ratio of the exhaust gas flowing into the exhaust purification catalyst 20 is controlled to the auxiliary rich set air-fuel ratio.

In the present embodiment, when the air-fuel ratio of the exhaust gas flowing out from the exhaust purification catalyst 20 becomes a predetermined lean judged air-fuel ratio or more, it is judged that the air-fuel ratio of the exhaust gas has become the lean air-fuel ratio. In the present embodiment, the lean judged air-fuel ratio is predetermined. For the lean judged air-fuel ratio, in the same way as the rich judged air-fuel ratio, considering the fine amount of fluctuation from the stoichiometric air-fuel ratio during the time period of operation, it is possible to employ a value slightly leaner than the stoichiometric air-fuel ratio. As such a lean judged air-fuel ratio, for example, 14.65 can be employed. In the present embodiment, a lean judgment reference value Irefx of the output current of the downstream side air-fuel ratio sensor 41 corresponding to the lean judged air-fuel ratio is preset.

Figure 11:
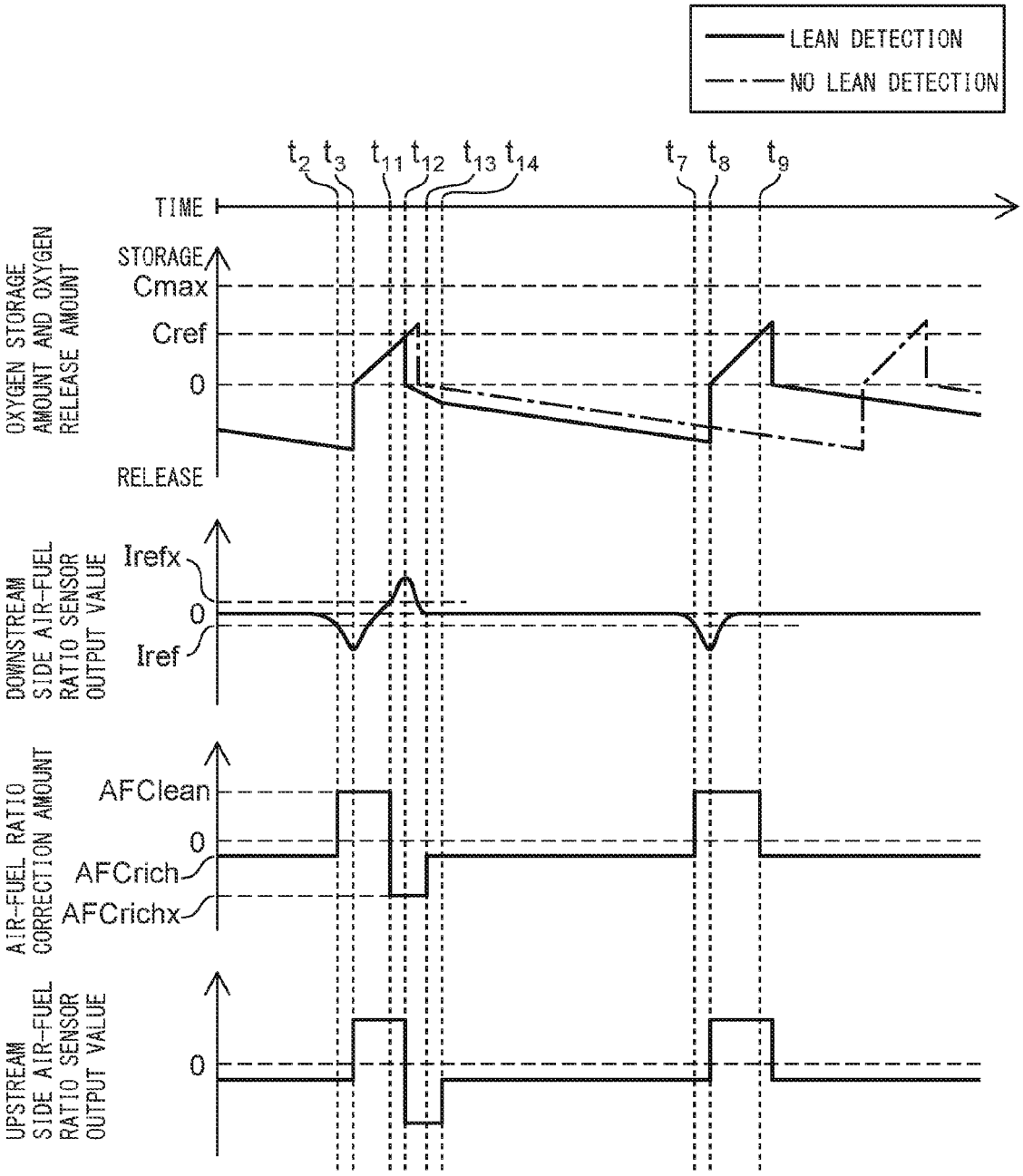
FIG. 11 A time chart of lean detection mode control in an embodiment.

FIG. 11 shows a time chart of lean detection mode control in the case where the air-fuel ratio of the exhaust gas flowing out from the exhaust purification catalyst becomes a lean air-fuel ratio. FIG. 11 shows a graph of the estimated value of the oxygen storage amount and the estimated value of the oxygen release amount of the exhaust purification catalyst 20 estimated by the electronic control unit 31. The oxygen release amount is shown as a negative value. The larger the absolute value, the greater the oxygen release amount that is shown. The oxygen storage amount is made zero when the air-fuel ratio of the exhaust gas flowing into the exhaust purification catalyst 20 is switched from the lean air-fuel ratio to the rich air-fuel ratio. Furthermore, the oxygen release amount is made zero when the air-fuel ratio of the exhaust gas flowing into the exhaust purification catalyst 20 is switched from the rich air-fuel ratio to the lean air-fuel ratio.

Up to the time $t_3$, control similar to the first normal operation control is performed (see FIG. 7). That is, at the time $t_2$, the output current Irdwn of the downstream side air-fuel ratio sensor 41 reaches the rich judgment reference value Iref. At the time $t_2$, the air-fuel ratio correction amount is switched from the weak rich set correction amount AFCrich to the lean set correction amount AFClean. At the time $t_3$, the air-fuel ratio of the exhaust gas flowing into the exhaust purification catalyst 20 becomes the lean air-fuel ratio corresponding to the lean set correction amount AFClean. At the time $t_3$ on, the oxygen storage amount of the exhaust purification catalyst 20 increases and the output current of the downstream side air-fuel ratio sensor 41 rises toward zero.

At this time, due to deterioration of the exhaust purification catalyst 20, disturbance of the air-fuel ratio at the time of combustion, etc., regardless of the oxygen storage amount of the exhaust purification catalyst 20 being less than the judgment reference storage amount Cref, the air-fuel ratio of the exhaust gas flowing out from the exhaust purification catalyst 20 becomes the lean air-fuel ratio. That is, the output current Irdwn of the downstream side air-fuel ratio sensor 41 becomes larger than zero. At the time $t_{11}$, the output current Irdwn of the downstream side air-fuel ratio sensor 41 reaches the lean judgment reference value Irefx.

At the time $t_{11}$, the control system of the present embodiment detects that the output current of the downstream side air-fuel ratio sensor 41 has reached the lean judgment reference value Irefx and performs the lean detection mode control. The air-fuel ratio correction amount is changed so that the air-fuel ratio of the exhaust gas flowing into the exhaust purification catalyst 20 becomes the auxiliary rich set air-fuel ratio. The air-fuel ratio correction amount switches the lean set correction amount AFClean to the auxiliary rich set correction amount AFCrichx. The auxiliary rich set correction amount AFCrichx is preset. In the example of control shown in FIG. 11, the auxiliary rich set correction amount AFCrichx is set so that the absolute value becomes larger than the weak rich set correction amount AFCrich.

At the time $t_{12}$, the output of the upstream side air-fuel ratio sensor 40 is switched from the lean air-fuel ratio to the rich air-fuel ratio. At the time $t_{12}$, the output current Irdwn of the downstream side air-fuel ratio sensor 41 is decreased. By controlling the air-fuel ratio of the exhaust gas flowing into the exhaust purification catalyst 20 to the rich air-fuel ratio in this way, it is possible to quickly return the output current of the downstream side air-fuel ratio sensor 41 to zero. That is, it is possible to make the air-fuel ratio of the inside of the exhaust purification catalyst 20 and the exhaust gas flowing out from the exhaust purification catalyst 20 the stoichiometric air-fuel ratio.

In the example shown in FIG. 11, the lean detection mode control is continued until the output current of the downstream side air-fuel ratio sensor 41 returns to zero. At the time $t_{13}$, the control system detects that the output current Irdwn of the downstream side air-fuel ratio sensor 41 has become zero and ends the lean detection mode control. At the time $t_{13}$, the air-fuel ratio correction amount is returned to the weak rich set correction amount AFCrich corresponding to the air-fuel ratio of rich control in normal operation control. At the time $t_{14}$, the air-fuel ratio of the exhaust gas flowing into the exhaust purification catalyst 20 is returned to the weak rich air-fuel ratio. At the time $t_{13}$ on, the above-mentioned normal operation control is performed.

The graph of the oxygen storage amount and oxygen release amount of FIG. 11 shows the case where the air-fuel ratio of the exhaust gas flowing out from the exhaust purification catalyst 20 does not become the lean air-fuel ratio by a one-dot chain line. When performing lean detection mode control, lean air-fuel ratio is switched to a rich air-fuel ratio in the state where the amount of oxygen is less than the amount of oxygen stored in lean control in normal operation control.

By performing lean detection mode control in the time period of normal operation control, it is possible to quickly return to the stoichiometric air-fuel ratio and suppress the outflow of $NO_X$ from the exhaust purification catalyst 20 when the inside of the exhaust purification catalyst 20 becomes the lean atmosphere.

In the above lean detection mode control, the auxiliary rich set air-fuel ratio of the lean detection mode control is made richer than the rich set air-fuel ratio of the rich control of normal operation control, but the invention is not limited to this. The auxiliary rich set air-fuel ratio may also be made the same as the rich set air-fuel ratio. That is, as the lean detection mode control, control may be performed to switch from the lean control to the rich control of normal operation control. In the following explanation, as the lean detection mode control, the explanation is given of the example of control for switching the lean control to the rich control of normal operation control.

<Explanation of Judgment Reference Decreasing Control and Catalyst Abnormality Judgment Control>

In the lean detection mode control, the air-fuel ratio of the exhaust gas flowing into the exhaust purification catalyst 20 is switched from the lean air-fuel ratio to the rich air-fuel ratio to suppress the outflow of $NO_X$. In this regard, when deterioration of the exhaust purification catalyst 20 along with aging etc. causes the maximum oxygen storage amount Cmax of the exhaust purification catalyst 20 to fall, sometimes the air-fuel ratio of the exhaust gas flowing out from the exhaust purification catalyst 20 becomes the lean air-fuel ratio each time performing the lean control. Therefore, the control system can perform judgment reference decreasing control for decreasing the judgment reference storage amount of the exhaust purification catalyst when detecting that the air-fuel ratio of the exhaust gas flowing out from the exhaust purification catalyst has become the lean air-fuel ratio during the time period for performing the lean control. In the judgment reference decreasing control, the amount of oxygen supplied to the exhaust purification catalyst 20 by the lean control (oxygen storage amount) is decreased.

The control system can judge when the air-fuel ratio of the exhaust gas has become the lean air-fuel ratio when the air-fuel ratio of the exhaust gas flowing out from the exhaust purification catalyst 20 has become a predetermined lean judged air-fuel ratio or more. For such lean judged air-fuel ratio, it is possible to employ a judgment value similar to the lean judged air-fuel ratio for the lean detection mode control. In the present embodiment, the lean judgment reference value Irefx of the output current of the downstream side air-fuel ratio sensor 41 corresponding to the lean judged air-fuel ratio is preset. Note that, the judgment value for judging that the air-fuel ratio of exhaust gas for judgment reference decreasing control has become the lean air-fuel ratio, and the judgment value for judging that the air-fuel ratio of exhaust gas for lean detection mode control becomes the lean air-fuel ratio may be different from each other.

In the judgment reference decreasing control in the present embodiment, the judgment reference storage amount Cref is decreased based on the number of times of lean control where the air-fuel ratio of the exhaust gas flowing out from the exhaust purification catalyst becomes the lean air-fuel ratio.

Figure 12:
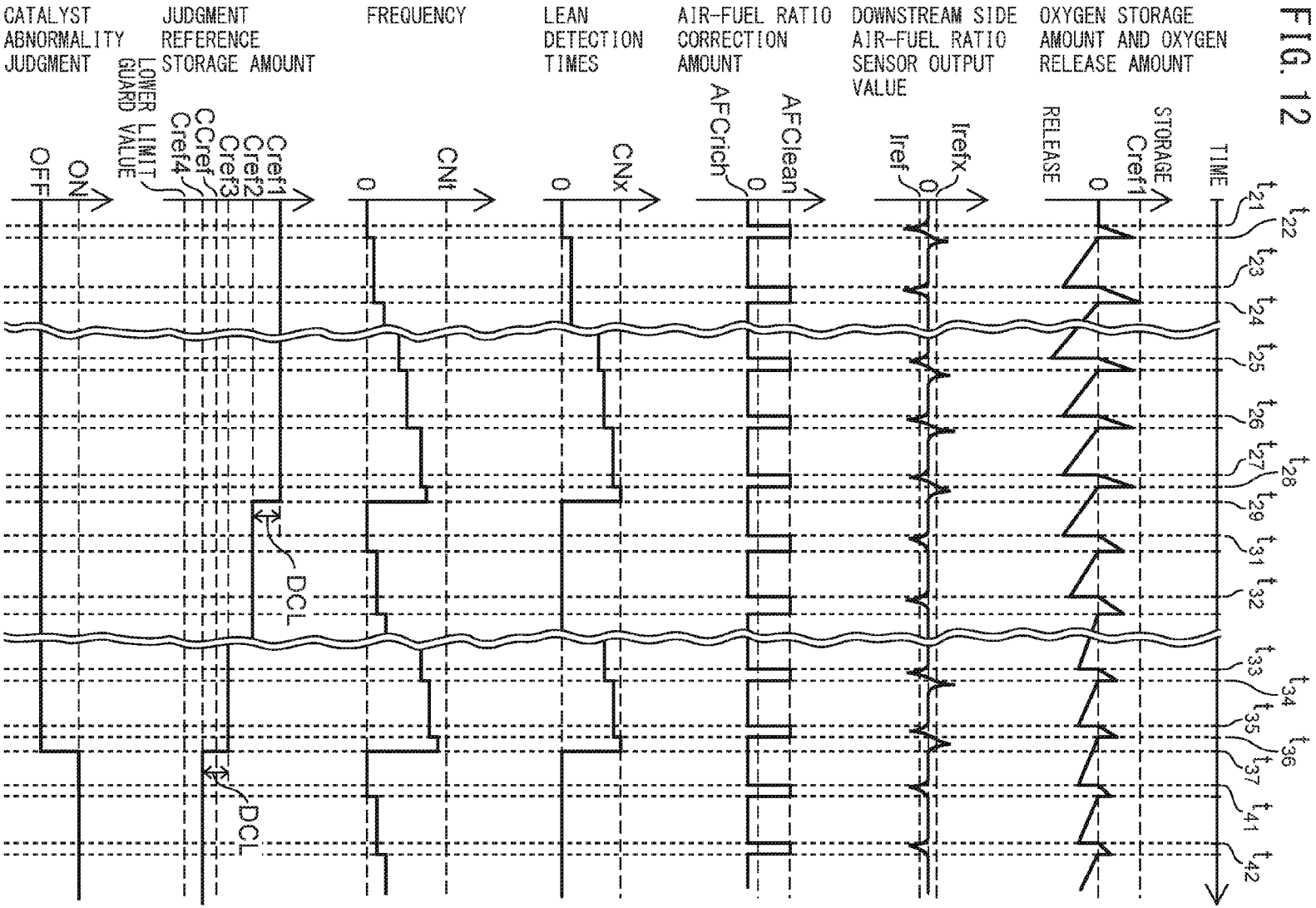
FIG. 12 A time chart of second normal operation control in an embodiment.

FIG. 12 shows a time chart in second normal operation control in the present embodiment. The initial judgment reference storage amount Cref1 before performing the judgment reference decreasing control is preset. Further, the lean detection mode control is performed if it is detected that the air-fuel ratio of the exhaust gas flowing out from the exhaust purification catalyst 20 is the lean air-fuel ratio. The "lean detection mode control" here switches the lean control of normal operation control to the rich control without performing control for temporarily setting a deep rich air-fuel ratio.

The control system detects the number of times of performing the lean control, that is, the frequency Nt. Further, the control system detects the number of times the air-fuel ratio of the exhaust gas flowing out from the exhaust purification catalyst 20 has become the lean air-fuel ratio, that is, the lean detection times Nx. In the present embodiment, it detects the number of times the output current Irdwn of the downstream side air-fuel ratio sensor 41 has become the lean judgment reference value Irefx or more.

Further, the control system performs judgment reference decreasing control for decreasing the judgment reference storage amount Cref when the lean detection times Nx reaches the lean detection time judgment value CNx before the frequency Nt reaches the frequency judgment value CNt. That is, it performs control for decreasing the judgment reference storage amount Cref when the number of times the air-fuel ratio of the exhaust gas flowing out from the exhaust purification catalyst 20 becomes the lean air-fuel ratio is detected by a predetermined ratio or more in the number of times of performing the lean control.

Up to the time $t_{21}$, the air-fuel ratio of the exhaust gas flowing out from the exhaust purification catalyst 20 does not become the lean air-fuel ratio and the judgment reference storage amount Cref1 is maintained constant. At the time $t_{22}$, the output current Irdwn of the downstream side air-fuel ratio sensor 41 reaches the lean judgment reference value Irefx and the lean detection mode control is performed. The air-fuel ratio correction amount is changed from the lean set correction amount AFClean to the weak rich set correction amount AFCrich.

Next, at the time $t_{23}$, the output current Irdwn of the downstream side air-fuel ratio sensor 41 reaches the rich judgment reference value Iref and the rich control is switched to the lean control. In the lean control at this time, the air-fuel ratio of the exhaust gas flowing out from the exhaust purification catalyst 20 does not reach the lean air-fuel ratio and is maintained at the substantially stoichiometric air-fuel ratio or less. At the time $t_{24}$, the estimated value of the oxygen storage amount reaches the judgment reference storage amount Cref1 and lean control is switched to the rich control. The lean detection mode control is not performed and one instance of lean control is ended.

In the plurality of instances of lean control, there is a mix of the cases where the air-fuel ratio of the exhaust gas flowing out from the exhaust purification catalyst 20 becomes the lean air-fuel ratio and the case where it is maintained at the stoichiometric air-fuel ratio or less. The control system increases the frequency Nt by 1 if performing the lean control one time. Further, the control system increases the lean detection times Nx by 1 if the lean air-fuel ratio is detected during the time period of one instance of lean control. In the example of control shown in FIG. 12, due to the lean control starting from the time $t_{21}$, the frequency Nt changes from 0 to 1. Further, the lean detection times Nx changes from 0 to 1. Due to the lean control starting from the time $t_{23}$, the frequency Nt changes from 1 to 2. On the other hand, the lean detection times Nx is maintained as is as "1".

In the normal operation control at the present embodiment, the rich control and the lean control are repeated while detecting the frequency Nt and lean detection times Nx. In the lean control starting from the time $t_{25}$, the time $t_{26}$, and the time $t_{27}$, the air-fuel ratio of the exhaust gas flowing out from the exhaust purification catalyst 20 becomes the lean air-fuel ratio. In these instances of lean control, the frequency Nt and the lean detection times Nx increase.

In the present embodiment, the frequency judgment value CNt relating to the frequency Nt of performing lean control is preset. Furthermore, the lean detection time judgment value CNx relating to the lean detection times Nx when it is judged that the air-fuel ratio of the exhaust gas flowing out from the exhaust purification catalyst has become the lean air-fuel ratio is preset.

In the lean control starting from the time $t_{27}$, at the time $t_{28}$, the output current Irdwn of the downstream side air-fuel ratio sensor 41 reaches the lean judgment reference value Irefx, and the lean detection mode control is performed. The lean detection times Nx is increased by 1, and the lean detection time judgment value CNx is reached. As opposed to this, the frequency Nt is increased by 1, but is less than the frequency judgment value CNt.

The control system detects that the lean detection times Nx reaches the lean detection time judgment value CNx before the frequency Nt reaches the frequency judgment value CNt. Further, the control system performs control for decreasing the judgment reference storage amount Cref at the time $t_{29}$. In the present embodiment, the amount of decrease DCL per one time is preset. The judgment reference storage amount Cref1 is changed to the judgment reference storage amount Cref2.

Note that, when the frequency Nt reaches the frequency judgment value CNt or the lean detection times Nx reaches the lean detection time judgment value CNx, control can be performed to make the frequency Nt and lean detection times Nx zero. That is, control can be performed to reset the frequency Nt and lean detection times Nx.

By decreasing the judgment reference storage amount Cref, the amount of oxygen stored in the exhaust purification catalyst 20 in one instance of lean control is decreased. For this reason, the number of times of control where the air-fuel ratio of the exhaust gas flowing out from the exhaust purification catalyst 20 becomes the lean air-fuel ratio can be decreased.

At the time $t_{29}$ on, in the lean control starting from the time $t_{31}$ and the lean control starting from the time $t_{32}$, in both instances of lean control, the air-fuel ratio of the exhaust gas flowing out from the exhaust purification catalyst 20 is maintained at the substantially stoichiometric air-fuel ratio or less.

If continuing the normal operation control, deterioration of the exhaust purification catalyst 20 causes the maximum oxygen storage amount Cmax to gradually decline. Further, due to the decreasing judgment reference control, the judgment reference storage amount Cref can be made to gradually decrease. At the time $t_{33}$ after continuing the normal operation control, this is decreased down to the judgment reference storage amount Cref3. Further, in the lean control starting at the time $t_{33}$, at the time $t_{34}$, the air-fuel ratio of the exhaust gas flowing out from the exhaust purification catalyst 20 becomes the lean air-fuel ratio.

In the lean control starting from the time $t_{35}$, at the time $t_{36}$, the air-fuel ratio of the exhaust gas flowing out from the exhaust purification catalyst 20 becomes the lean air-fuel ratio, the lean detection times Nx is increased by 1, and the frequency Nt is increased by 1. As a result, the lean detection times Nx reaches the lean detection time judgment value CNx. The control system performs control for decreasing the judgment reference storage amount Cref by the amount of decrease DCL at the time $t_{37}$. The judgment reference storage amount Cref3 is changed to the judgment reference storage amount Cref4.

For the normal operation control at the time $t_{37}$ on, similar control is repeated. In the lean control starting from the time $t_{41}$ and the lean control starting from the time $t_{42}$, the oxygen storage amount reaches the judgment reference storage amount Cref4, and the lean control is switched to the rich control.

In this way, in the second normal operation control, when performing lean control a plurality of times, control for decreasing the judgment reference storage amount is performed when a lean air-fuel ratio is detected by a predetermined ratio or more. In other words, in the judgment reference decreasing control, the judgment reference storage amount is decreased when the ratio of the number of times the air-fuel ratio of the exhaust gas flowing out from the exhaust purification catalyst has become the lean judged air-fuel ratio or more to the number of times of performing the lean control becomes larger than a predetermined judgment value.

Further, in the present embodiment, when performing a plurality of instances of the lean control, when the ratio by which the lean air-fuel ratio is detected is less than a predetermined judgment value of the ratio, the judgment reference storage amount is maintained. If the frequency Nt reaches the frequency judgment value CNt before the lean detection times Nx reaches the lean detection time judgment value CNx, the judgment reference storage amount Cref is maintained without change.

By performing the judgment reference decreasing control, it is possible to reduce the oxygen storage amount of the exhaust purification catalyst 20 when switching from the lean control to the rich control. That is, in lean control, it is possible to make the amount of oxygen supplied to the exhaust purification catalyst 20 an amount smaller than the maximum oxygen storage amount Cmax reduced due to deterioration of the exhaust purification catalyst 20 etc. The judgment reference storage amount can be set to correspond to the change of the maximum oxygen storage amount Cmax of the exhaust purification catalyst. As a result, the exhaust purification catalyst 20 does not store oxygen and the inside of the exhaust purification catalyst 20 can be kept from becoming a lean atmosphere. It is possible to keep $NO_X$ from flowing out from the exhaust purification catalyst 20.

In this regard, when the oxygen storage ability of the exhaust purification catalyst 20 becomes less than a predetermined oxygen storage ability, it can be judged that the exhaust purification catalyst 20 has deteriorated and is abnormal. The control system of the present embodiment performs catalyst abnormality judgment control for judging if the exhaust purification catalyst 20 is abnormal. If repeating judgment reference decreasing control, the judgment reference storage amount Cref gradually declines. In second normal operation control, when the judgment reference storage amount Cref is less than the predetermined deterioration judgment value CCref, it is judged that the exhaust purification catalyst is abnormal.

In the example of control shown in FIG. 12, at the time $t_{37}$, the judgment reference storage amount Cref decreases and becomes less than the deterioration judgment value CCref. The control system detects that the judgment reference storage amount Cref is less than the deterioration judgment value CCref and judges that the exhaust purification catalyst 20 is abnormal. For example, the control system turns on a warning light provided on an instrument panel at the front of the driver's seat and showing an abnormality of the exhaust purification catalyst. The user can confirm that the warning light for indicating an abnormality of the exhaust purification catalyst is turned on and request repair of the exhaust purification catalyst.

Figure 13:
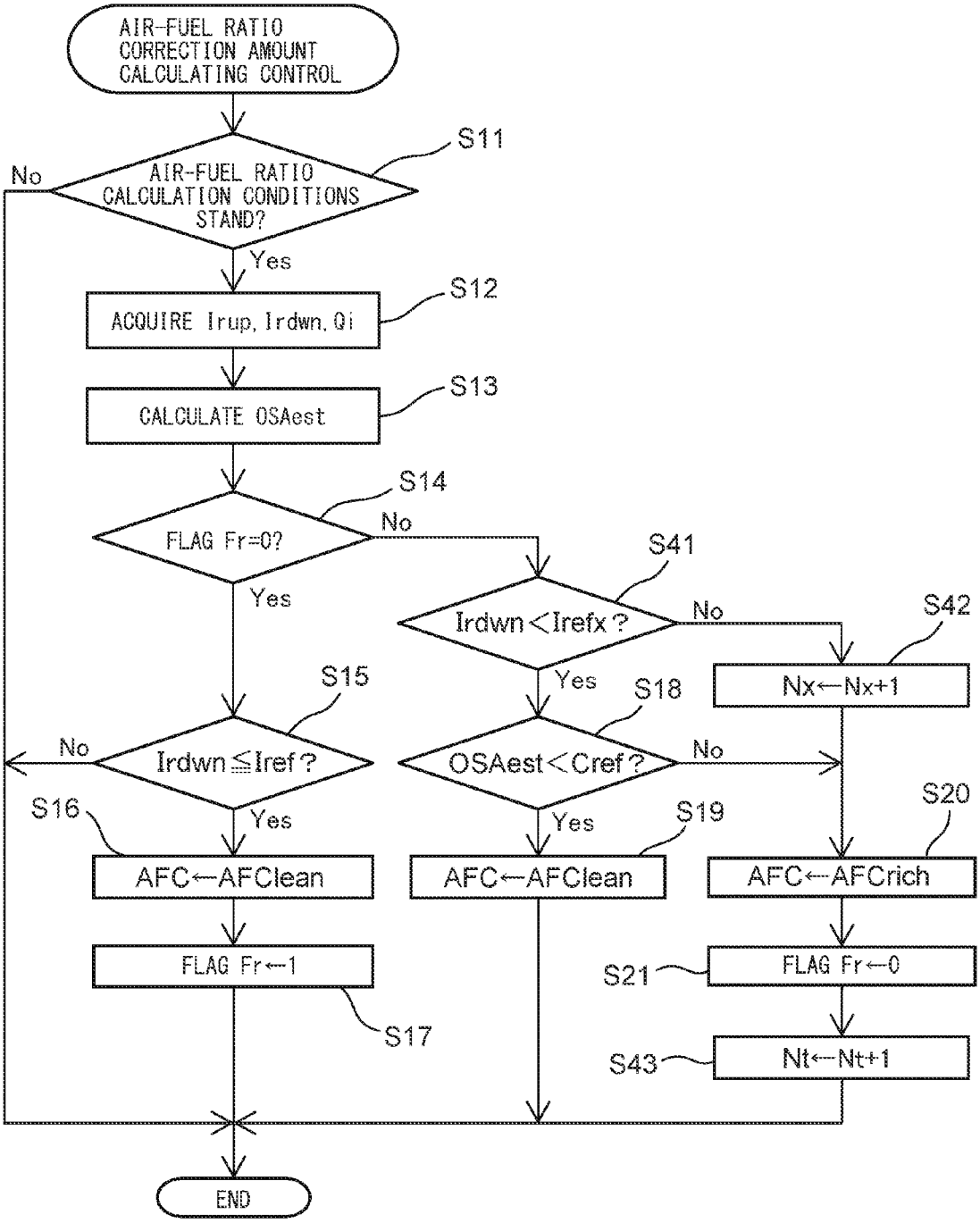
FIG. 13 A flow chart of second normal operation control in an embodiment.

FIG. 13 shows a flow chart of second normal operation control of the present embodiment. Step S11 to step S14 are similar to the first normal operation control (see FIG. 10).

When, at step S14, the lean set flag Fr is not 0, the routine proceeds to step S41. That is, when the air-fuel ratio correction amount is set to the lean set correction amount and the lean control is performed, the routine proceeds to step S41. At step S41, it is judged if the output current Irdwn of the downstream side air-fuel ratio sensor 41 has reached the lean judgment reference value Irefx. That is, it is judged if the air-fuel ratio of the exhaust gas flowing out from the exhaust purification catalyst 20 is less than the predetermined lean judged air-fuel ratio.

When, at step S41, the output current Irdwn of the downstream side air-fuel ratio sensor 41 is the lean judgment reference value Irefx or more, the routine proceeds to step S42. In this case, it can be judged that the air-fuel ratio of the exhaust gas flowing out from the exhaust purification catalyst 20 is a lean air-fuel ratio. At step S42, control for increasing the lean detection times Nx by 1 is performed.

Next, at step S20, the air-fuel ratio correction amount AFC is changed to the weak rich set correction amount AFCrich. That is, lean control is switched to the rich control. At step S21, the lean set flag Fr is changed from "1" to "0". Next, at step S43, the frequency Nt is increased by "1".

On the other hand, when, at step S41, the output current Irdwn of the downstream side air-fuel ratio sensor 41 is less than the lean judgment reference value Irefx, the routine proceeds to step S18. At step S18, it is judged if the estimated value OSAest of the oxygen storage amount has reached the judgment reference storage amount Cref. When, at step S18, the estimated value OSAest of the oxygen storage amount is less than the judgment reference storage amount Cref, the routine proceeds to step S19. At step S19, the air-fuel ratio correction amount AFC is set to the lean set correction amount AFClean where the lean control is continued.

When, at step S18, the estimated value OSAest of the oxygen storage amount is the judgment reference storage amount Cref or more, the routine proceeds to step S20. In this case, oxygen is stored until the judgment reference storage amount without the air-fuel ratio of the exhaust gas flowing out from the exhaust purification catalyst 20 reaching the lean judged air-fuel ratio. In this case, at step S20 and step S21, the lean control is switched to the rich control. Further, at step S43, the frequency Nt is increased by "1". When, at step S14, the lean set flag Fr is 0, the routine is similar to the first normal operation control shown in FIG. 10.

In this way, in the second normal operation control, the number of times of performing the lean control, that is, the frequency Nt, and the number of times the air-fuel ratio of the exhaust gas flowing out from the exhaust purification catalyst 20 becomes lean air-fuel ratio, that is, the lean detection times Nx, are detected.

Figure 14:
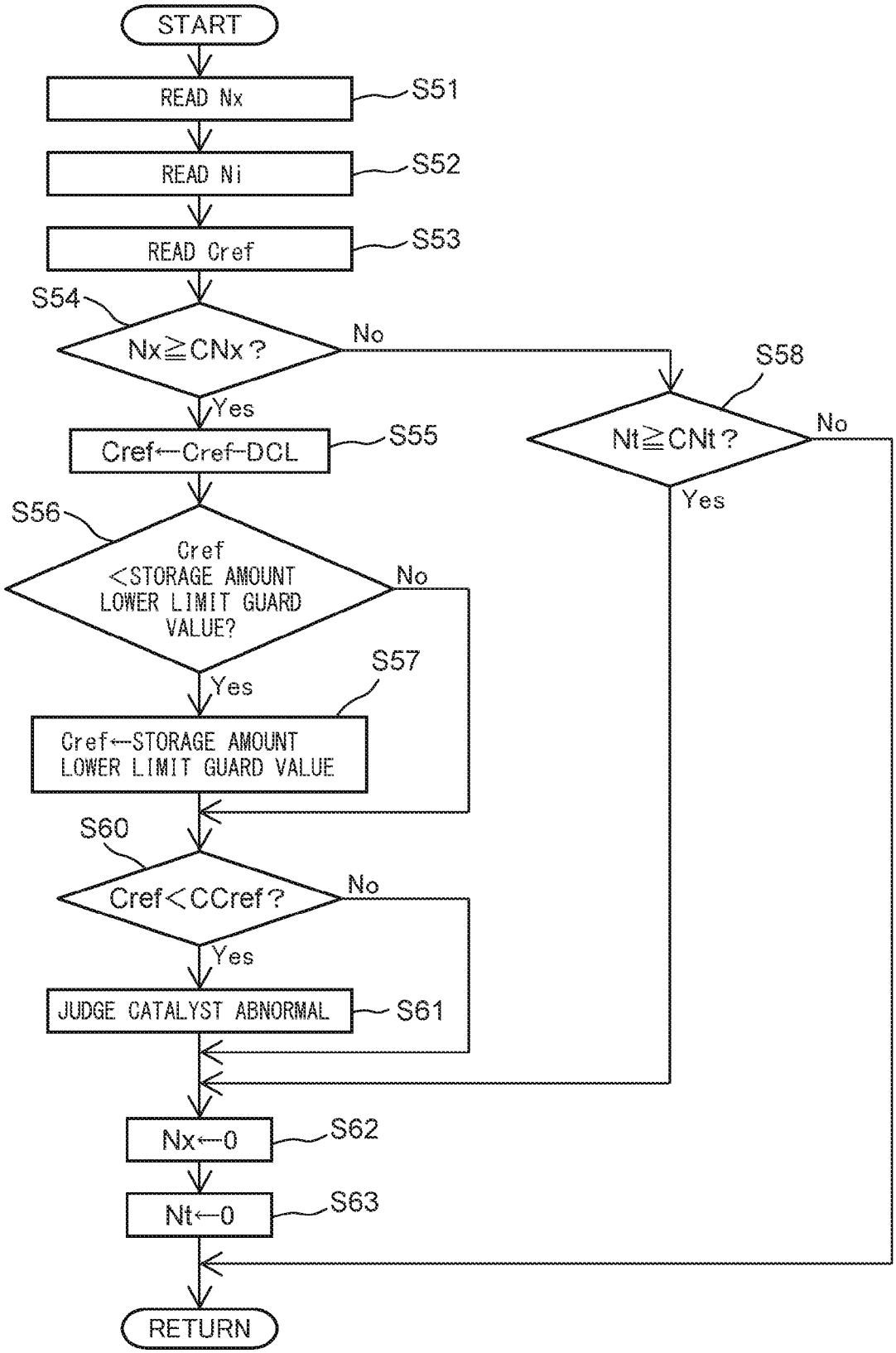
FIG. 14 A flow chart of control judging deterioration of the exhaust purification catalyst in second normal operation control of an embodiment.

FIG. 14 shows a flow chart of control for setting the judgment reference storage amount and control for judging abnormality of the exhaust purification catalyst in the second normal operation control. The control shown in FIG. 14 can, for example, be performed every predetermined time interval. Alternatively, the routine can be performed each time one lean control is ended.

At step S51, the current lean detection times Nx is read. At step S52, the current frequency Nt is read. At step S53, the current judgment reference storage amount Cref is read.

At step S54, it is judged if the lean detection times Nx is the lean detection time judgment value CNx or more. That is, it is judged if the lean detection times Nx has reached the lean detection time judgment value CNx. When the lean detection times Nx is the lean detection time judgment value CNx or more, the routine proceeds to step S55. At step S55, control for decreasing the judgment reference storage amount Cref is performed. In the present embodiment, a preset decrease amount DCL is used to decrease the judgment reference storage amount.

Here, if repeating control for decreasing the judgment reference storage amount Cref, the judgment reference storage amount is liable to become zero or less. For example, the judgment reference storage amount is liable to become a negative value. In this regard, the oxygen storage amount cannot become less than zero. Alternatively, in the control system of the present embodiment, if the judgment reference storage amount decreases to a predetermined deterioration judgment value, the control system performs control for notifying the user of an abnormality of the exhaust purification catalyst. When notifying the user of an abnormality of the exhaust purification catalyst, there is less meaning in managing the judgment reference storage amount to further decrease it, since the user is asked to exchange the exhaust purification catalyst etc.

For this reason, at the present embodiment, as the guard value of the lower limit of the judgment reference storage amount, a storage amount lower limit guard value is preset. The storage amount lower limit guard value is a value set so that the judgment reference storage amount does not become less than the storage amount lower limit guard value. Alternatively, the minimum value of the range where it is necessary to set a judgment reference storage amount is the storage amount lower limit guard value.

At step S56, it is judged if the judgment reference storage amount Cref calculated at step S55 is less than a preset storage amount lower limit guard value. If, at step S56, the judgment reference storage amount Cref is less than the storage amount lower limit guard value, the routine proceeds to step S57. At step S57, as the judgment reference storage amount Cref, the storage amount lower limit guard value is employed. If, at step S56, the judgment reference storage amount Cref is the storage amount lower limit guard value or more, the judgment reference storage amount Cref set at step S55 is employed.

Next, at step S60, it is judged if the judgment reference storage amount Cref is less than the deterioration judgment value CCref. If, at step S60, the judgment reference storage amount Cref is less than the deterioration judgment value CCref, the routine proceeds to step S61. At step S61, it is possible to judge that the exhaust purification catalyst 20 is abnormal. Further, the control system turns on a warning light showing that the exhaust purification catalyst 20 is abnormal.

When, at step S60, the judgment reference storage amount Cref is the deterioration judgment value CCref or more, it can be judged that the oxygen storage ability of the exhaust purification catalyst 20 is within an allowable range. It is possible to judge that the exhaust purification catalyst 20 is normal. In this case, the routine proceeds to step S62.

At step S62, the lean detection times Nx is made zero. Further, at step S63, the frequency Nt is made zero. In this way, judgment reference decreasing control for decreasing the judgment reference storage amount and catalyst abnormality judgment control for judging if the exhaust purification catalyst is deteriorating can be performed.

On the other hand, when, at step S54, the lean detection times Nx is less than the lean detection time judgment value CNx, the routine proceeds to step S58. At step S58, it is judged if the frequency Nt is the frequency judgment value CNt or more. That is, it is judged if the frequency Nt has reached the frequency judgment value CNt. When, at step S58, the frequency Nt is less than the frequency judgment value CNt, this control is ended.

When, at step S58, the frequency Nt is the frequency judgment value CNt or more, the routine proceeds to step S62. In this case, before the lean detection times Nx reaches the lean detection time judgment value CNx, the frequency Nt reaches the frequency judgment value CNt. The judgment reference storage amount is maintained at the current value and the lean detection times Nx and the frequency Nt are reset. At step S62, the lean detection times Nx is made zero. Further, at step S63, the frequency Nt is made.

In this way, the control system of the present embodiment can decrease the progression of deterioration of the exhaust purification catalyst 20 and the judgment reference storage amount. Furthermore, the control system can judge if the exhaust purification catalyst 20 is abnormal.

The judgment reference decreasing control is not limited to the above embodiment. It is performed when the air-fuel ratio of the exhaust gas flowing out from the exhaust purification catalyst becomes a lean air-fuel ratio. For example, the judgment reference decreasing control may also not detect the frequency of the lean control but perform control for decreasing the judgment reference storage amount when the lean detection times reaches a predetermined judgment value of the number of times. Alternatively, it is also possible to decrease the judgment reference storage amount each time performing one instance of lean detection mode control. Furthermore, in the most recent predetermined number of times of performing lean control, when the number of times the air-fuel ratio of the exhaust gas flowing out from the exhaust purification catalyst reaches the lean air-fuel ratio has reached a predetermined judgment value of the number of times, control for decreasing the judgment reference storage amount may be performed.

Note that, when, during the time period of performing lean control, the air-fuel ratio of the exhaust gas flowing out from the exhaust purification catalyst 20 becomes the lean air-fuel ratio, control for reducing the lean set air-fuel ratio in the lean control need not be performed. That is, the air-fuel ratio of the exhaust gas flowing into the exhaust purification catalyst 20 in the lean control may be changed to the rich side. If the exhaust purification catalyst 20 deteriorates etc., the amount of oxygen stored in the exhaust purification catalyst 20 per unit time decreases. That is, the storage speed of oxygen falls. By changing the lean set air-fuel ratio to the rich side, it is possible to reduce the amount of oxygen flowing in per unit time and possible to keep the inside of the exhaust purification catalyst 20 from becoming the lean atmosphere. As a result, it is possible to keep $NO_X$ from flowing out from the exhaust purification catalyst 20.

Further, in the judgment of the air-fuel ratio of the exhaust gas flowing out from the exhaust purification catalyst 20, sometimes mistaken judgment is performed due to fluctuations in the air-fuel ratio at the time of combustion etc. Alternatively, if the adsorption of hydrocarbons or sulfur etc. causes the maximum oxygen storage amount to temporarily decrease, sometimes the maximum oxygen storage amount is restored. Alternatively, sometimes the amount of decrease of the judgment reference storage amount in the judgment reference decreasing control is too large. For this reason, when the air-fuel ratio of the exhaust gas flowing out from the exhaust purification catalyst 20 is maintained at less than the lean judged air-fuel ratio during the time period of performing the lean control, it is also possible to perform control for making the judgment reference storage amount increase. Furthermore, if the air-fuel ratio of the exhaust gas flowing out from the exhaust purification catalyst 20 is maintained at less than the lean judged air-fuel ratio during the time period of performing lean control, control may also be performed for changing the lean set air-fuel ratio in lean control to the lean side.

Figure 15:
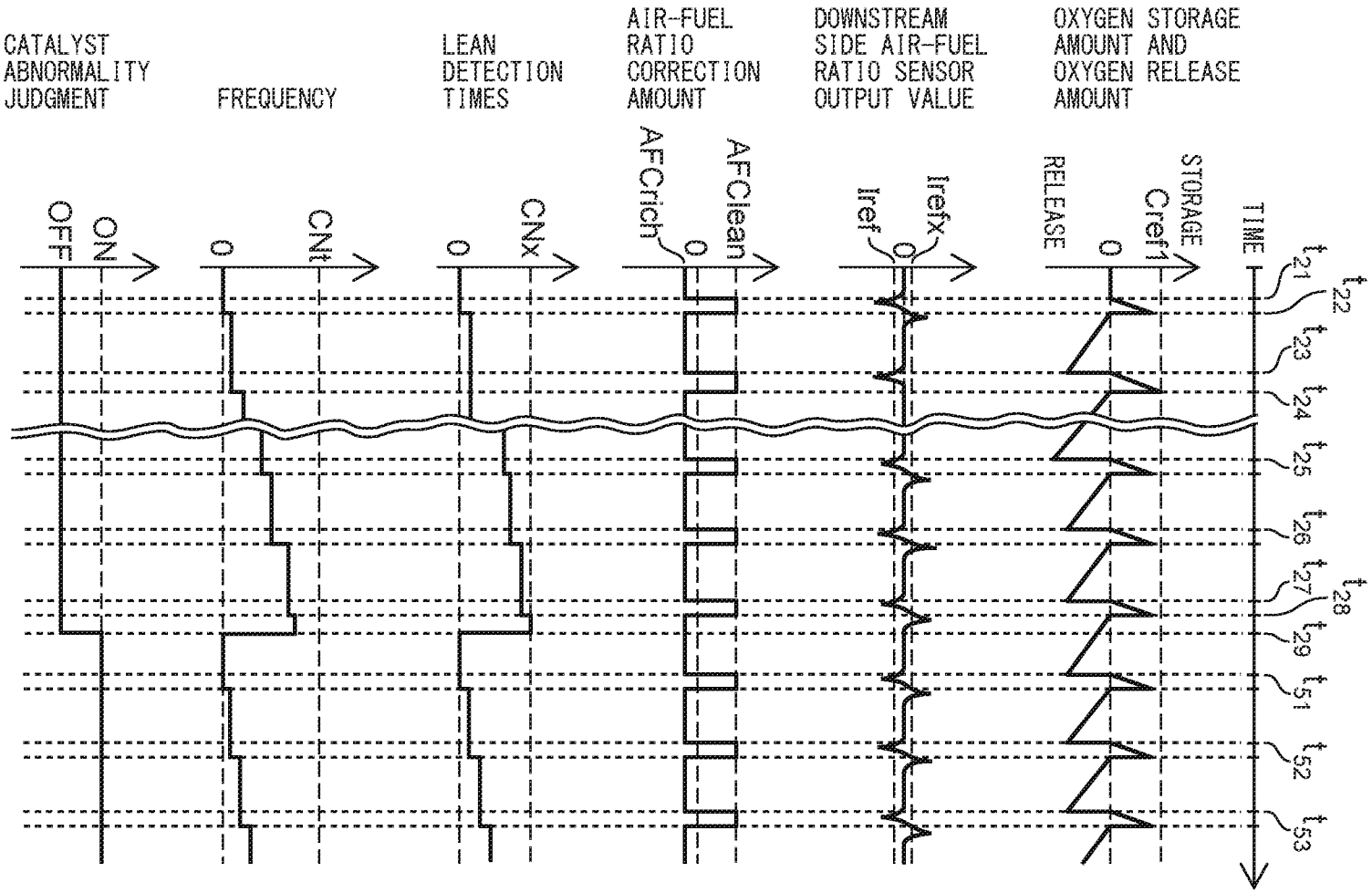
FIG. 15 A time chart of third normal operation control in an embodiment.

FIG. 15 shows a time chart of third normal operation control in the present embodiment. In the third normal operation control, it is judged if there is any abnormality of the exhaust purification catalyst 20 based on the number of times of performing the lean control and the number of times of performing the lean detection mode control without changing the judgment reference storage amount Cref.

The control from the time $t_{21}$ to the time $t_{28}$ is similar to the second normal operation control (see FIG. 12). In the lean control starting from the time $t_{27}$, at the time $t_{28}$, the output current Irdwn of the downstream side air-fuel ratio sensor 41 reaches the lean judgment reference value Irefx and lean detection mode control is performed. The lean detection times Nx is increased by 1 and reaches the judgment value CNx of the lean detection times. As opposed to this, the frequency Nt is less than the frequency judgment value CNt.

The control system, at the time $t_{29}$, detects that the lean detection times Nx has reached the lean detection time judgment value CNx before the frequency Nt reaches the frequency judgment value CNt. The control system can judge that the exhaust purification catalyst 20 has deteriorated and become abnormal. At the time $t_{29}$, the frequency Nt and lean detection times Nx are reset to zero. From the time $t_{51}$ on, the normal operation control is continued.

In this way, in the third normal operation control, it is judged if the exhaust purification catalyst is abnormal based on the ratio of the number of times of performing the lean detection mode control to the number of times of performing the lean control. More specifically, it is judged that the exhaust purification catalyst is abnormal if the ratio of the number of times the air-fuel ratio of the exhaust gas flowing out from the exhaust purification catalyst has become the lean judged air-fuel ratio or more to the number of times of performing the lean control becomes larger than a predetermined ratio judgment value.

Figure 16:
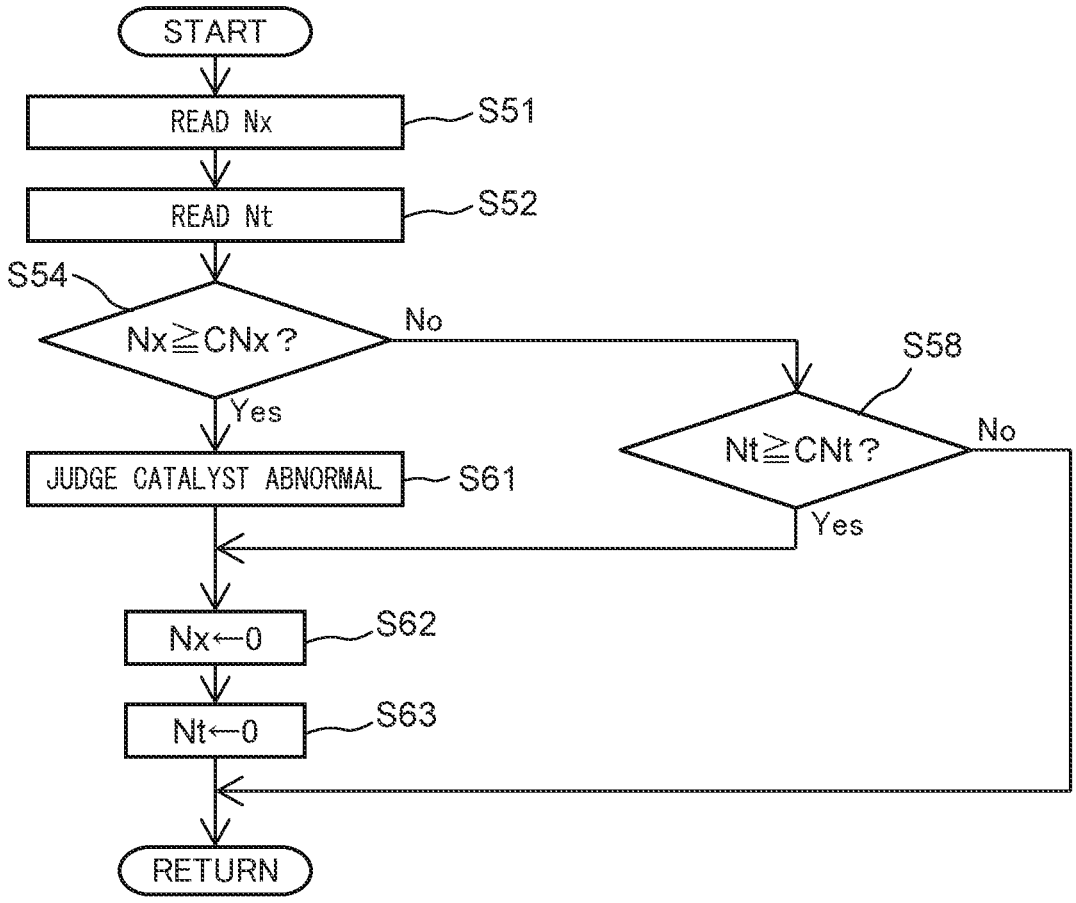
FIG. 16 A flow chart of control judging deterioration of the exhaust purification catalyst in third normal operation control of an embodiment.
Figure 17:
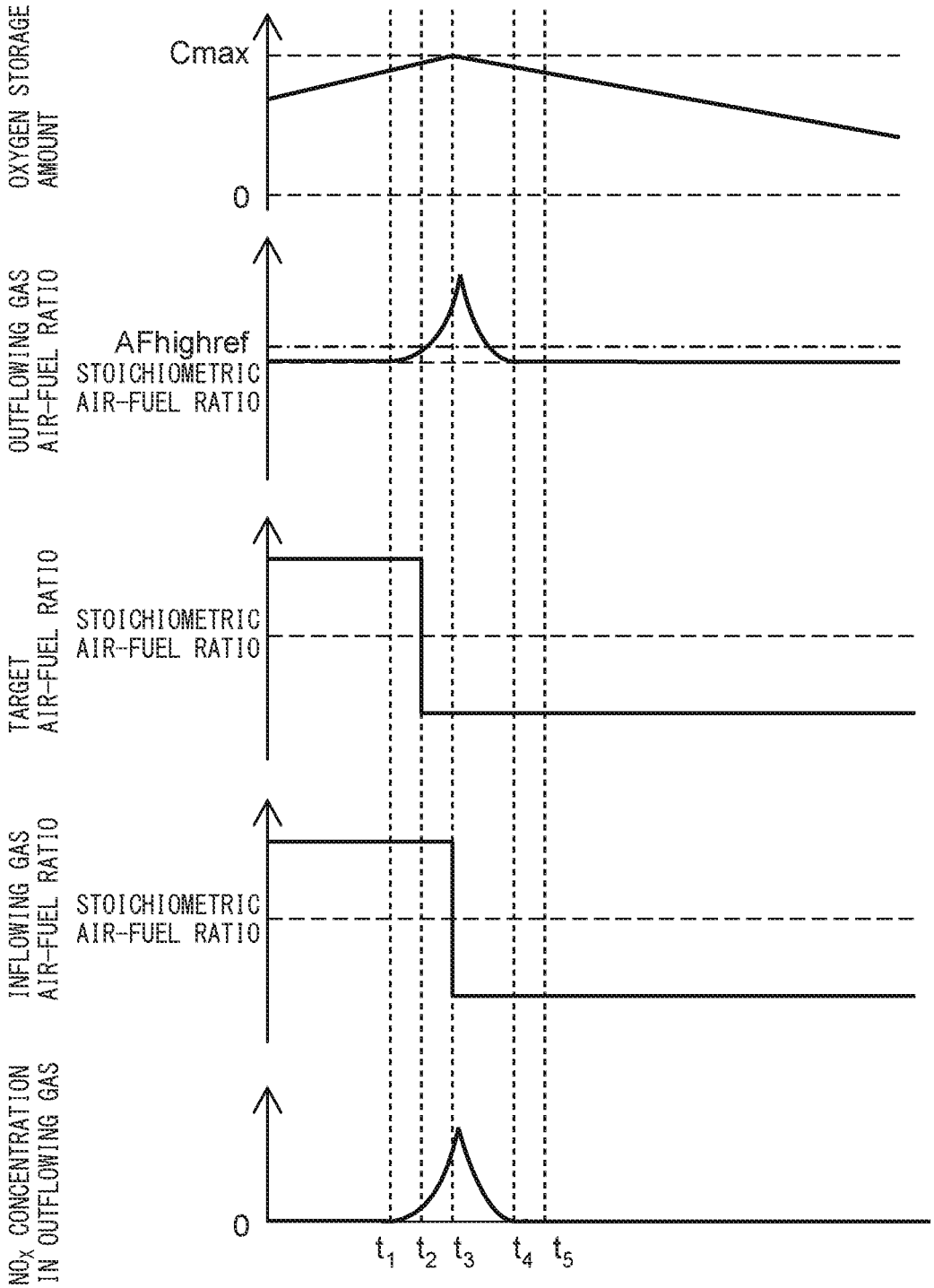
FIG. 17 A time chart of control in the prior art.

FIG. 16 shows a flow chart of catalyst abnormality judgment control for judging if the exhaust purification catalyst is abnormal in the third normal operation control of the present embodiment. The control shown in FIG. 16 can, for example, be performed every predetermined time interval. Alternatively, it can be performed every time one instance of lean control is ended.

Step S51 to step S54 are similar to the second normal operation control (see FIG. 14). If, at step S54, the lean detection times Nx is the lean detection time judgment value CNx or more, the routine proceeds to step S61. At step S61, it is judged if the exhaust purification catalyst 20 has deteriorated and is abnormal. Further, at step S62, the lean detection times Nx is made zero. Further, at step S63, the frequency Nt is made zero.

On the other hand, if, at step S54, the lean detection times Nx is less than the lean detection time judgment value CNx, the routine proceeds to step S58. At step S58, it is judged if the frequency Nt is the frequency judgment value CNt or more. If, at step S58, the frequency Nt is less than the frequency judgment value CNt, this control is ended.

If, at step S58, the frequency Nt is the frequency judgment value CNt or more, the routine proceeds to step S62. In this case, it can be judged that the exhaust purification catalyst 20 is normal. Further, at step S62 and step S63, the lean detection times Nx and the frequency Nt are reset to zero.

In this way, in the third normal operation control, it can be judged if the exhaust purification catalyst is abnormal without changing the judgment reference storage amount. Note that, in the above control, the number of times of performing the lean control is made zero when reaching a predetermined judgment value of the number of times, but the invention is not limited to this. The judgment may also be made based on the most recent predetermined number of times of performing lean control. That is, in the most recent predetermined number of times of performing lean control, it is also possible to judge if the exhaust purification catalyst is abnormal when the number of times the air-fuel ratio of the exhaust gas flowing out from the exhaust purification catalyst reaches the lean air-fuel ratio reaches a predetermined judgment value of the number of times.

In the lean control of the present embodiment, the air-fuel ratio of the exhaust gas flowing into the exhaust purification catalyst is made continuously leaner than the stoichiometric air-fuel ratio, but the invention is not limited to this. The air-fuel ratio of the exhaust gas flowing into the exhaust purification catalyst may also be made discontinuously leaner than the stoichiometric air-fuel ratio. Further, similarly, in the rich control as well, it is possible to make the air-fuel ratio of the exhaust gas flowing into the exhaust purification catalyst richer than the stoichiometric air-fuel ratio continuously or discontinuously.

In the above controls, the order of the steps can be suitably changed within a range where the functions and actions are not changed. In the above-mentioned figures, the same or corresponding parts are assigned the same reference notations. Note that, the above embodiments are illustrative and do not limit the invention. Further, the embodiments further include changes in the aspects shown in the claims.

REFERENCE SIGNS LIST

5. combustion chamber
11. fuel injector
19. exhaust manifold
20. exhaust purification catalyst
31. electronic control unit
40. upstream side air-fuel ratio sensor
41. downstream side air-fuel ratio sensor

The invention claimed is:

1. A control system of an internal combustion engine provided with an exhaust purification catalyst having an oxygen storage ability in an engine exhaust passage, the control system comprising:

an upstream side air-fuel ratio sensor arranged upstream of the exhaust purification catalyst and detecting an air-fuel ratio of exhaust gas flowing into the exhaust purification catalyst, a downstream side air-fuel ratio sensor arranged downstream of the exhaust purification catalyst and detecting an air-fuel ratio of exhaust gas flowing out from the exhaust purification catalyst, and a computer including a processor and memory, the control system is configured to:

acquire a storage amount of oxygen stored in the exhaust purification catalyst, and perform normal operation control including lean control for continuously or discontinuously making the air-fuel ratio of the exhaust gas flowing into the exhaust purification catalyst a lean set air-fuel ratio leaner than the stoichiometric air-fuel ratio until an oxygen storage amount of the exhaust purification catalyst becomes a judgment reference storage amount, which is less than a maximum oxygen storage amount, and rich control for continuously or discontinuously making the air-fuel ratio of the exhaust gas flowing into the exhaust purification catalyst a rich set air-fuel ratio richer than the stoichiometric air-fuel ratio until an output of the downstream side air-fuel ratio sensor becomes a rich judged air-fuel ratio, which is an air-fuel ratio richer than the stoichiometric air-fuel ratio, wherein the normal operation control includes control switching to the rich control during the time period of the lean control when the oxygen storage amount becomes the judgment reference storage amount or more- and switching to the lean control during the time period of the rich control when the output of the downstream side air-fuel ratio sensor becomes the rich judged air-fuel ratio or less, wherein a lean judged air-fuel ratio is preset in a predetermined range where the air-fuel ratio of the exhaust gas flowing out from the exhaust purification catalyst is a lean air-fuel ratio leaner than the stoichiometric air-fuel ratio, and wherein the normal operation control includes judgment reference decreasing control decreasing the judgment reference storage amount in the lean control when during the time period of performing the lean control, the air-fuel ratio of the exhaust gas flowing out from the exhaust purification catalyst becomes the lean judged air-fuel ratio or more.

2. The control system of an internal combustion engine according to claim 1, wherein the control system detects the number of times of performing the lean control and the number of times the air-fuel ratio of the exhaust gas flowing out from the exhaust purification catalyst has become the lean judged air-fuel ratio or more, and performs the judgment reference decreasing control when a ratio of the number of times the air-fuel ratio of the exhaust gas flowing out from the exhaust purification catalyst has become the lean judged air-fuel ratio or more to the number of times of performing the lean control becomes larger than a predetermined judgment value.

3. The control system of an internal combustion engine according to claim 1, wherein the normal operation control includes control maintaining the judgment reference storage amount when the air-fuel ratio of the exhaust gas flowing out from the exhaust purification catalyst is being maintained at less than the lean judged air-fuel ratio during the time period of performing the lean control.

4. A control system of an internal combustion engine provided with an exhaust purification catalyst having an oxygen storage ability in an engine exhaust passage, the control system comprising:

an upstream side air-fuel ratio sensor arranged upstream of the exhaust purification catalyst and detecting an air-fuel ratio of exhaust gas flowing into the exhaust purification catalyst, a downstream side air-fuel ratio sensor arranged downstream of the exhaust purification catalyst and detecting an air-fuel ratio of exhaust gas flowing out from the exhaust purification catalyst, and a computer including a processor and memory, the control system is configured to:

acquire a storage amount of oxygen stored in the exhaust purification catalyst, and perform normal operation control including lean control for continuously or discontinuously making the air-fuel ratio of the exhaust gas flowing into the exhaust purification catalyst a lean set air-fuel ratio leaner than the stoichiometric air-fuel ratio until an oxygen storage amount of the exhaust purification catalyst becomes a judgment reference storage amount, which is less than a maximum oxygen storage amount, and rich control for continuously or discontinuously making the air-fuel ratio of the exhaust gas flowing into the exhaust purification catalyst a rich set air-fuel ratio richer than the stoichiometric air-fuel ratio until an output of the downstream side air-fuel ratio sensor becomes a rich judged air-fuel ratio, which is an air-fuel ratio richer than the stoichiometric air-fuel ratio, wherein the normal operation control includes control switching to the rich control during the time period of lean control when the oxygen storage amount becomes the judgment reference storage amount or more and switching to the lean control during the time period of rich control when the output of the downstream side air-fuel ratio sensor becomes the rich judged air-fuel ratio or less, wherein a lean judged air-fuel ratio is preset in a predetermined range where the air-fuel ratio of the exhaust gas flowing out from the exhaust purification catalyst is a lean air-fuel ratio leaner than the stoichiometric air-fuel ratio, wherein the control system detects the number of times of performing the lean control and the number of times the air-fuel ratio of the exhaust gas flowing out from the exhaust purification catalyst has become the lean judged air-fuel ratio or more, and wherein the control system judges that the exhaust purification catalyst is abnormal when a ratio of the number of times the air-fuel ratio of the exhaust gas flowing out from the exhaust purification catalyst has become the lean judged air-fuel ratio or more to the number of times of performing the lean control becomes larger than a predetermined ratio judgment value.

5. The control system of an internal combustion engine according to claim 2, wherein the normal operation control includes control maintaining the judgment reference storage amount when the air-fuel ratio of the exhaust gas flowing out from the exhaust purification catalyst is being maintained at less than the lean judged air-fuel ratio during the time period of performing the lean control.

6. The control system of an internal combustion engine according to claim 1, wherein the control system judges that the exhaust purification catalyst is abnormal when the judgment reference storage amount becomes less than a predetermined deterioration judgment value.

* * * * *